US010638855B2

(12) United States Patent
Cichuta et al.

(10) Patent No.: US 10,638,855 B2
(45) Date of Patent: May 5, 2020

(54) SELF-SERVING RACK

(71) Applicant: Lidl Stiftung & Co. KG, Neckarsulm (DE)

(72) Inventors: Denis Cichuta, Neckarsulm (DE); Oliver Menke, Neckarsulm (DE); Philipp Bange, Neckarsulm (DE); Hernan De La Vega, Neckarsulm (DE)

(73) Assignee: Lidl Stiftung & Co. KG, Neckarsulm (DE)

( * ) Notice: Subject to any disclaimer, the term of this patent is extended or adjusted under 35 U.S.C. 154(b) by 0 days.

(21) Appl. No.: 15/630,531

(22) Filed: Jun. 22, 2017

(65) Prior Publication Data

US 2018/0000259 A1 Jan. 4, 2018

(30) Foreign Application Priority Data

Jun. 28, 2016 (DE) ..... 10 2016 111 835
Jun. 28, 2016 (DE) ..... 20 2016 103 424 U

(51) Int. Cl.
*A47F 1/04* (2006.01)
*A47F 3/00* (2006.01)
(Continued)

(52) U.S. Cl.
CPC ..... *A47F 1/04* (2013.01); *A47F 3/001* (2013.01); *A47F 3/005* (2013.01); *A47F 3/02* (2013.01);
(Continued)

(58) Field of Classification Search
CPC .. A47F 1/04; A47F 3/001; A47F 3/005; A47F 3/02; A47F 3/06; A47F 5/0025;
(Continued)

(56) References Cited

U.S. PATENT DOCUMENTS 591,739 A * 10/1897 Crandall et al. ..... F25D 23/02 312/292
785,883 A * 3/1905 Honabarger ..... A47F 1/10 221/106
(Continued)

FOREIGN PATENT DOCUMENTS

DE 3019463 A1 11/1981
DE 3223804 C1 3/1984
(Continued)

OTHER PUBLICATIONS

German Patent and Trademark Office, Office Action for German Patent Application No. 102016111835.4, dated Jul. 26, 2016, 2 pages.
(Continued)

*Primary Examiner* — Jennifer E. Novosad
(74) *Attorney, Agent, or Firm* — Kolisch Hartwell, P.C.

(57) ABSTRACT

A dispensing shelf for storing, presenting and dispensing food products that require hygiene protection, the dispensing shelf including a rack defining at least one storage space for storing and visibly displaying food products, and at least one retrieval space that coincides at least partially with the at least one storage space. A front side includes a storage front plate with a retrieval opening for retrieving food products from the dispensing shelf. The at least one storage space and the at least one retrieval space are at least partially arranged in an interior of the rack. The retrieval opening is positioned in the storage front plate and defined by an edge portion of one or plural storage front plates which envelop the retrieval opening.

26 Claims, 12 Drawing Sheets

Figure 1A:
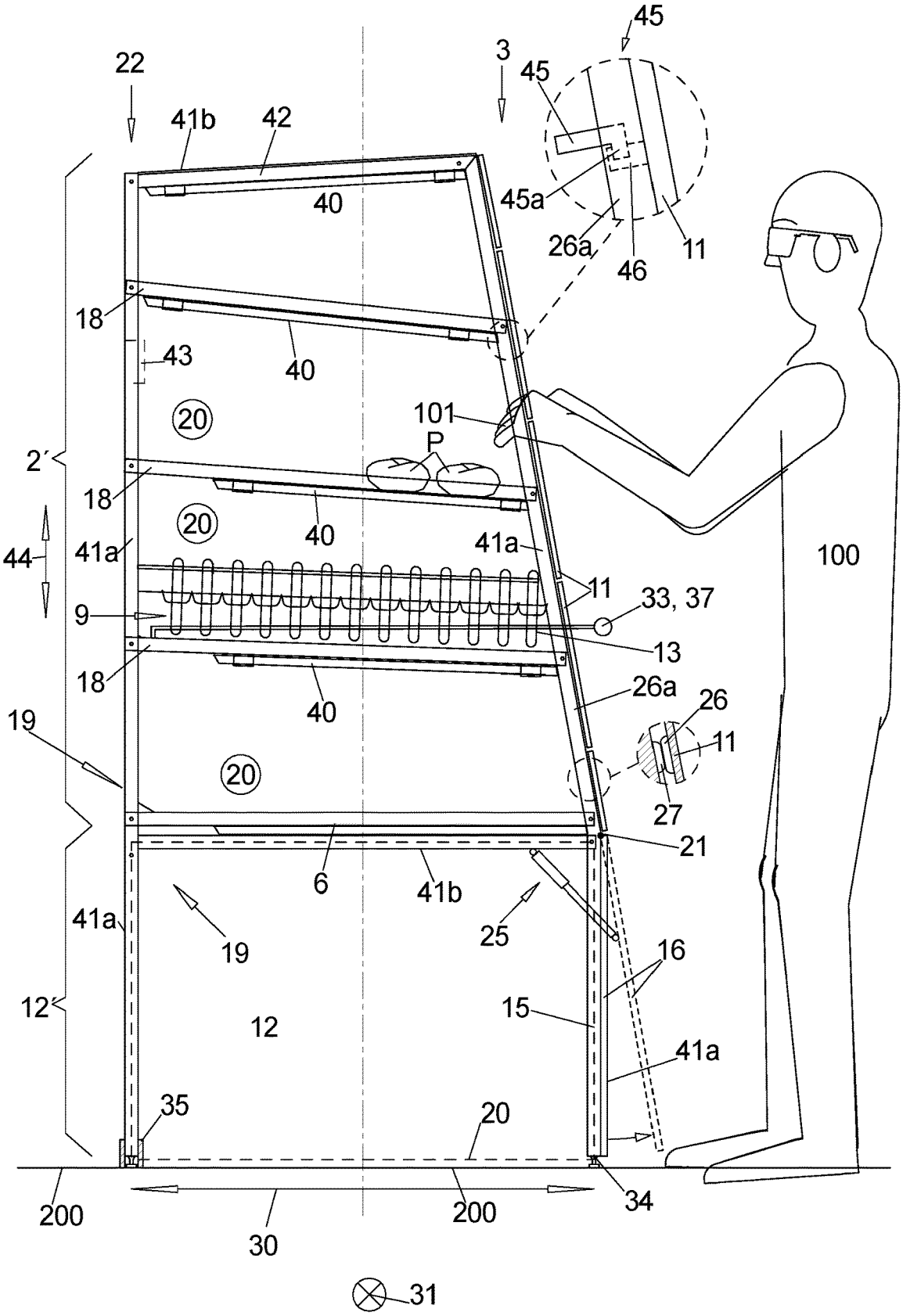

(51) Int. Cl.

| | |
|---|---|
| ***A47F 3/02*** | (2006.01) |
| ***A47F 3/06*** | (2006.01) |
| ***A47F 5/00*** | (2006.01) |
| ***A47F 10/06*** | (2006.01) |

(52) U.S. Cl.

CPC ..... *A47F 3/06* (2013.01); *A47F 5/0025* (2013.01); *A47F 10/06* (2013.01); *A47F 2003/021* (2013.01); *A47F 2010/065* (2013.01)

(58) Field of Classification Search

CPC ..... A47F 10/06; A47F 2003/021; A47F 2010/065; A47F 3/063; A47F 1/00; A47F 7/0071; A47F 3/04; A47F 3/0404; A47F 3/0434; A47F 3/0408; A47F 3/0413; A47F 3/043; A47F 3/0439; A47F 3/0452; A47F 3/0456; A47F 3/0486; A47F 3/00; A47F 1/12; A47F 5/0081; A47F 3/007; A47F 2003/008; A47F 2003/066; A47F 3/12; A47F 3/125; A47B 75/00

USPC ..... 211/59.2, 189; 221/92, 197; 312/36, 312/107, 114, 116, 117, 118, 119, 122, 312/126, 127, 128, 129, 130, 131, 138.1, 312/139.1, 211, 292

See application file for complete search history.

(56) References Cited

U.S. PATENT DOCUMENTS 1,011,112 A * 12/1911 Burlingame ..... A47F 3/005 312/131
1,626,013 A * 4/1927 Sherer ..... A47F 3/001 312/117
1,642,533 A * 9/1927 Beer ..... A47G 29/1201 232/25
1,763,716 A * 6/1930 Michaelson ..... A47F 3/005 312/119
1,854,104 A * 4/1932 Frank ..... A47F 3/001 312/114
1,999,021 A * 4/1935 Marsh ..... A47F 1/08 221/197
2,106,839 A * 2/1938 Gilbert ..... A47F 3/001 108/23
2,136,558 A * 11/1938 Manshel ..... F25D 23/04 312/276
2,356,687 A * 8/1944 O'Reilly ..... G07F 9/10 211/128.1
2,409,117 A * 10/1946 Fero ..... A47F 3/005 312/107
2,803,512 A * 8/1957 Band ..... E05B 65/467 312/216
2,919,051 A 12/1959 Wideburg et al.
2,940,642 A 6/1960 Strattman
3,911,248 A * 10/1975 Buday ..... A47F 3/04 126/21 A
D301,419 S 6/1989 Rosen
5,447,366 A * 9/1995 Cole ..... A47F 3/005 312/202
5,593,048 A * 1/1997 Johnson ..... A47F 1/04 211/184
D437,509 S 2/2001 Eustace
6,241,328 B1 * 6/2001 Ziff ..... A61C 13/12 312/1
D446,964 S 8/2001 Alexandersson
6,619,814 B1 * 9/2003 Hamada ..... A47F 3/001 362/125
D480,429 S 10/2003 Koebbe
D593,771 S 6/2009 Petruccelli
D667,234 S 9/2012 Maroney et al.
D684,795 S 6/2013 Koenigsknecht et al.
D726,455 S 4/2015 Collini
D747,901 S 1/2016 Kanagy et al.
D752,372 S 3/2016 Huff et al.
D784,052 S 4/2017 Rodriguez
D798,635 S 10/2017 Aguilera et al.
D814,215 S 4/2018 Yan
D815,469 S 4/2018 Volz et al.
D817,039 S 5/2018 Adolph et al.
D818,605 S 5/2018 Menon et al.
D837,576 S 1/2019 Murthy et al.
D839,639 S 2/2019 Nourie
D841,372 S 2/2019 Murthy et al.
2002/0005686 A1 * 1/2002 Nuttall ..... A47F 3/001 312/236
2002/0072323 A1 * 6/2002 Hakemann ..... A47F 3/001 454/233
2002/0089842 A1 * 7/2002 Santosuosso ..... A47F 3/001 362/92
2004/0144794 A1 * 7/2004 Clarke ..... A47F 1/04 221/2
2005/0030736 A1 * 2/2005 Chuang ..... A47F 3/001 362/92
2006/0180602 A1 8/2006 Hertel
2007/0138167 A1 * 6/2007 Friedman ..... A47F 3/001 219/544
2008/0006591 A1 * 1/2008 Corrente ..... A47F 3/005 211/85.26
2008/0029517 A1 2/2008 Briers
2008/0169735 A1 * 7/2008 Yamazaki ..... A47F 3/001 312/114
2008/0277361 A1 * 11/2008 Primiano ..... A47F 3/001 211/49.1
2008/0304252 A1 * 12/2008 Shibusawa ..... A47F 3/001 362/125
2011/0017763 A1 * 1/2011 Colelli ..... A47F 1/125 221/1
2013/0019625 A1 * 1/2013 Bryce ..... A47F 3/0408 62/251
2014/0230295 A1 8/2014 Hawkins
2014/0292168 A1 * 10/2014 Nevarez ..... A47F 3/001 312/236
2015/0230631 A1 * 8/2015 Nuttall ..... A47F 7/0071 312/400
2016/0058205 A1 * 3/2016 Da Silva ..... A47F 3/02 221/92
2016/0242572 A1 * 8/2016 Goto ..... A47F 3/06
2017/0099959 A1 * 4/2017 Hardy ..... A47F 1/126
2018/0000259 A1 * 1/2018 Cichuta ..... A47F 1/04

FOREIGN PATENT DOCUMENTS

DE 9205290 7/1992
DE 9305088 U1 10/1993
DE 4412503 A1 10/1995
DE 9412893 U1 10/1995
DE 29510894 U1 11/1995
DE 29510232 U1 2/1996
DE 29518948 U1 2/1996
DE 29518950 U1 2/1996
DE 20104106 6/2001
DE 20114012 U1 12/2001
DE 202004009530 U1 10/2004
DE 10318279 11/2004
DE 202005009376 U1 9/2005
DE 202007014304 U1 1/2008
DE 102006013435 B4 3/2008
DE 202007006139 U1 10/2008
DE 202007009953 U1 12/2008
DE 202008001290 U1 7/2009
DE 202009006328 U1 8/2009
DE 102005049193 B4 9/2009
DE 202009004271 9/2009
DE 202009008829 U1 10/2009
DE 202011104571 U1 1/2012
DE 202011104060 U1 12/2012
DE 202013100425 2/2013
DE 102011113339 3/2013
DE 202011106702 U1 3/2013
DE 202013100425 U1 3/2013

(56) References Cited

FOREIGN PATENT DOCUMENTS

| | | | |
|---|---|---|---|
| DE | 202013105382 | | 12/2013 |
| DE | 202013105382 | U1 | 1/2014 |
| DE | 202012012003 | | 3/2014 |
| DE | 202013010353 | | 2/2015 |
| DM | 079559 | | 11/2012 |
| DM | 079945 | | 1/2013 |
| EP | 0618154 | B1 | 12/1996 |
| EP | 1669009 | A1 | 6/2006 |
| EP | 1688042 | A2 | 8/2006 |
| EP | 1728456 | A1 | 12/2006 |
| EP | 2084995 | | 8/2009 |
| EP | 2084995 | B1 | 10/2011 |
| EP | 2248447 | B1 | 10/2011 |
| EP | 2248448 | B1 | 10/2011 |
| EP | 2570054 | A1 | 3/2013 |
| EP | 2580996 | | 4/2013 |
| WO | 8907902 | A | 9/1989 |
| WO | 2014118202 | A1 | 8/2014 |
| WO | 2014118203 | A1 | 8/2014 |

OTHER PUBLICATIONS

German Patent and Trademark Office, Office Action for German Patent Application No. 102016111835.4, dated Jul. 26, 2016, 4 pages.

* cited by examiner

SELF-SERVING RACK

I. FIELD OF THE INVENTION

The invention relates to a dispensing shelf for storing presenting and dispensing food products that require hygienic protection to a retrieving person, thus a self-service customer.

II. TECHNICAL BACKGROUND

In order to sell unpackaged products that require hygienic protection thus e.g. baked goods which are to be retrieved from a corresponding dispensing shelf by a retrieving person there are hygienic regulations how to hygienically protect the product to be sold that differ from country to country.

In particular it shall be prevented that germ transmission occurs from a first retrieving person through the stored products to other retrieving persons which is possible for example when a product is touched by a retrieving person but not retrieved and subsequently retrieved by another retrieving person and consumed thereafter. Also a dropping of products onto the floor shall be prevented if possible.

For producers and operators of such dispensing shelves this means that the dispensing shelves have to be provided with different protective devices and thus configuration elements depending on local regulations.

It is another problem that hygiene regulations in different countries change from time to time. Depending on the type of change this can mean the complete replacement of currently used dispensing shelves against new dispensing shelves that comply with new regulations which is very complex for an operator and not only expensive but also time consuming.

Since the dispensing shelves for different hygiene regulations however include some components that are always present and required independently from hygiene regulations and which are being used in the same form or only in few variants a retro fitting or reconfiguration of existing dispensing shelves can be performed when hygiene regulations change when the dispensing shelves can be assembled from different modules included in the kit which are connected with each other in a disengage able manner.

III. BRIEF SUMMARY OF THE INVENTION a) Technical Object

Thus it is an object of the invention to provide a dispensing shelf which complies with most hygiene regulations up to a particular hygiene level and which can advantageously be retrofitted for more stringent hygiene requirements.

Thus it is an object of the invention to provide a dispensing shelf kit from which a plurality of dispensing shelves with different configurations can be assembled e.g. corresponding to the local hygiene regulations as required.

b) Solution

This object is achieved by the features according to claims 1 and 15. Advantageous embodiments can be derived from the dependent claims.

With respect to the dispensing shelf the object is achieved in that the retrieving space provided at least partially within the rack of the dispensing shelf from which the products are retrieved by the retrieving person includes a retrieving opening in a front side of the retrieving space that is oriented towards the retrieving person.

This simple accessibility prevents that retrieved products fall down. Furthermore this makes the sides of the dispensing shelf available for arranging the dispensing shelves in particularly gapless rows.

The rack of the retrieving shelf is advantageous made from a frame work of profiles mostly metal profiles which extend at least along the edges of the dispensing shelf which advantageously approximately has the shape of an upright cuboid, wherein advantageously its front surface, at least in its upper portion slopes backward upward at a slant angle.

Accordingly the rack includes upright, in particular vertically standing upright profiles and transversal profiles extending in a horizontal direction in the transversal direction in front of the retrieving person as well as in the depth direction, thus extending in the direction from the front side oriented towards the retrieving person to the opposite back side of the dispensing shelf.

Typically the storage space simultaneously forms the retrieving space for the products in that one or plural products are directly retrievable from the storage space which typically holds a plurality of products instead of moving the products from the storage space into a retrieving space that is separate therefrom.

Typically plural storage spaces and/or retrieving spaces are arranged in the dispensing shelf on top of one another wherein the plural storage spaces and/or retrieval spaces are separated from each other by divider elements that are arranged there between typically covering the entire cross section of the dispensing shelf at this location and typically plate shaped, thus e.g. a storage dish for products to be stored therein.

The divider elements typically contact support beams that are attached at the rack, advantageous bolted down and the divider element are retrievable from the feed side of the shelf, the back side and/or the front side by operators.

Thus, not only empty storage dishes can be replaced with storage dishes that can be filled with products but also other plate shaped divider elements can be arranged on the support bars, for example heating plates or cooling plates.

The disengage able attachment that is disengage able in a simple and quick manner, advantageously without tools of as many components as possible advantageous of all components of the dispensing shelf at the rack is also a hygiene aspect since all removed components can be cleaned separately more intensively or can be disinfected and then also the remaining storage shelf in particular the rack can be cleaned in a particularly thorough manner.

The divider elements themselves and thus also the support bars are typically arranged upward slanting in depth direction from front to back in order to display the products stored thereon in a manner that is better visible for the retrieving person. When plural divider elements are arranged on top of one another their slope also increases from bottom to top in order to better view the products stored thereon.

There are several options to configure a front of the dispensing shelves.

The retrieving opening required on the front side for retrieving products can be an open front side of the storage space in a simplest case. Without additional measures then however the products can for example fall down easily.

Therefore a storage front plate partially closing the front side is often provided wherein the storage front plate is in particular provided as a transparent front pane for example made from glass in which a retrieval opening is provided for retrieving the products, wherein the retrieval opening is large enough in order to reach through by hand or also by a first of a retrieving person from an outside into the retrieving space and also large enough in order to be able to retrieve the largest product in the retrieving space through the retrieving opening.

Advantageously the bottom side of the retrieving opening is above the height of the front side of the respective retrieving space but advantageously not above the center of the height of the front side of the respective retrieving space.

Thus, a stop is provided by the storage front place wherein the stop protrudes from a surface of the divider element at its front edge, wherein the stop prevents products from falling down.

Advantageously the storage front plate extends like a frame about the retrieving opening, wherein the circumferential frame can be interrupted at one or plural locations of the circumference.

Instead of a retrieving opening which facilitates reaching inside with one hand and which can furthermore be configured in different sizes also a very much smaller tool opening can be provided which is too small to put a hand through and which only suffices to put a tool, e.g. a rod shaped center element of a pusher or gripper or gripper tongs through and thus grip a product in an interior of the storage space or move it either towards an outlet opening or into an adjacent retrieval space.

A retrieval opening that is smaller compared to the entire front side causes already due to its small size a reduction of a probability that contaminants in any form penetrate the storage space and also that products can fall down to easily over the forward lower edge of the retrieving space. Still the products are visible quite well when the storage front plate is configured transparent.

The storage front plate is advantageous movably attached at the dispensing shelf, in particular at its rack and configured as a one or two panel door which continues in elevation over one or more levels or as a flap, e.g. an upward opening flap.

In case the opening storage front plate can be opened by everybody, including the retrieving person the storage front plate can also be a storage front plate that completely closes the front side of the retrieving space in closed condition, wherein the storage front plate respectively has to be opened by the retrieving person. In this case it is advantageous to configure the front plate as a pivot plate which protrudes in open condition and advantageously also during the opening process as little as possible, at the most for example 5 cm beyond the front side of the retrieving space and which does ideally not protrude at all beyond the front side.

In the closed condition a move able flap can be kept in position due to its own weight, e.g. for a flap that is arranged high in the shelf or which has a pivot axis that extends horizontally at the upper edge of the flap or by a locking mechanism.

A locking mechanism of this type can be for example a magnet closure in that a magnet is arranged at the storage front plate at a suitable location and a magnetize able metal component is arranged at the opposite component for example at a profile of the rack or vice versa. Thus the profile is typically made from magnetize able metal anyhow.

Since a movable storage front plate that is configured as a door closes self-acting due to its tare weight when the front side is sloped backward upward advantageously at least an impact damper is provided at the rack or at the move able storage front plate, wherein the impact damper is made for example from an elastic material and is configured in particular as a cap made from shock absorbing plastic material which sits on the magnet.

The locking mechanism however can also be configured lockable when the storage front plate includes a retrieval opening or at least a tool opening and can for example be provided with a lock, at least so that the locking mechanism can be advantageously disengaged by personnel and the move able storage front plate can be opened.

The retrieval opening and/or tool opening that is advantageously centrally arranged in the front side of a compartment can be enveloped as a frame by one or plural storage front plates and can be made from an upper storage front plate element and a lower storage front plate element when plural storage front plates are provided which are respectively arranged at the rack separately move able when one storage front plate is to be opened.

Thus, a storage front plate element of this type can also extend with respect to height over a divider element so that also for example the upper storage front plate element of a storage space and the lower storage front plate element of the adjacent storage space are configured integral in one piece together as so called transition front plate which reduces a number of required individual components.

Advantageously some, in particular all storage front plates used at a storage shelf or storage front plates, in particular the transition front plates are configured identical which typically requires a coinciding elevation distance of the individual divider elements arranged in the dispensing shelf, in particular when using transition front plates, terminal front plates that differ from the transition front plates are additionally required at the upper and lower end of the storage portion of the dispensing shelf configured with the storage spaces.

Typically not the entire height of the rack is filled with storage spaces and/or retrieval spaces that are arranged on top of each other but only its upper portion, the so called storage portion since an output shelf of this type typically rests on the ground and the lower portion up to approximately knee height of the retrieving person cannot be used as a storage space due to a lack of visibility and impaired accessibility.

The base space provided below the lowest storage space and/or retrieval space is primarily used as a spacer to the ground and is typically closed on the front side by a base front plate which is advantageously also move ably attached between an open position and the closed position at the rack.

A movable base front plate of this type is configured in particular as a base front plate that is pivot able upward, in particular about its upper edge so that the base front plate does not impact the rack with its lower end gravity induced too quickly and with excessive impact force during closing. Therefore a closing damper advantageously in the form of a gas pressure damper is provided.

The base front plate is used in the closing position on the one hand side to close the base space so nobody can look in. Therefore the base front plate is typically made from non-transparent material in order to not be able to see products or contaminations that are stored in the base space there behind.

The base front plate is furthermore used to prevent in particular children from reaching in or reaching through from the front side to the back side of the dispensing shelf.

The open position of the base front plate is used to be able to quickly and simply clean the base in the portion of the dispensing shelf also in the base space.

The front of the base front plate can also be used for attaching advertising material.

For the stated reasons in a dispensing shelf where the next dispensing shelf does not adjoin directly laterally typically also the site surfaces of the base space are closed by side plates which however are typically not arranged move ably but only this mountable with or without tools.

The base front plate can be additionally used for receiving additional functional elements.

For this purpose a pass through opening is provided in the base front plate typically in its upper portion that is still well accessible wherein a box with paper bags or disposable gloves is attached at a back side of the base front plate and wherein the box is open through the pass through opening so that the retrieving person can retrieve a paper bag from the box for transporting the products retrieved by the retrieving person from the dispensing shelf or a disposable glove in order not to have to touch the product with bare hands when reaching through the retrieving opening and ripping the product.

By the same token a recycling container can be provided behind the pass through opening for throwing in for example products that fell on the floor, torn paper bags or similar, wherein the pass through opening in the base front plate is typically closed by a self-closing, e.g. spring loaded flap or door which only swings inward into an open condition when the retrieving person presses against it.

Configuring the front surface of the base front plate is important for the quality perception of the dispensing shelf.

A coating on the front surface is advantageous here wherein the coating is made from a material that feels like wood with respect to optical appearance and heat conductivity and which includes in particular also wood components while still not being wood, though the base material of the base front plate is typically a wood material like a particle board.

The coating is in particular a paper material which includes wood components and which in particular includes a three dimensional structuring of its surface which feels e.g. like a natural surface of cut wood where in particular when sanded harder components protrude a little more than the slightly recessed softer components that are ground off more quickly.

In order to be able to apply commercial signs in particular configured as magnet foils in spite of a coating that includes wood components wherein the base front plate is also made from a wood base material so that the signs can be switched quickly without causing damage for example with targeted commercial campaigns wherein the commercial signs adhere to a magnetize able thus typically metal base. The base front plate in particular its base material can include a metal insert which suffices to let a magnet like e.g. a magnet foil adhere to the front surface of the base front plate. The metal insert can be a metal layer, in particular between the base material and the front side coating or an insert that is embedded deeper in the base material, e.g. made from a metal grid or offset metal rods.

The same applies for the side plates which at least substantially close the side surfaces of the dispensing shelf, in particular the side surfaces of the individual compartments in case these are not made from a metal base material anyhow.

Also the rack can be configured in various embodiments.

On the one hand side insertion openings can be provided in the profiles of the rack wherein the insertion openings are used in open condition for inserting additional elements for the dispensing shelf wherein the insertion openings can be closed in non-used condition e.g. plastic covers that are insert able into the insertion opening and close at least its open side.

Furthermore at least one forward transversal rod can extend as a component of a forward price sticker unit between the forward upright profiles of the frame thus advantageously between an elevation position so that it is in front of or slightly below the forward narrow side of the divider element, for example a storage dish. At this forward transversal rod a forward price sticker holder is attached which typically extends over an entire width of the front side wherein price stickers are insert able into the price sticker holder from above. The transversal rod is advantageously only hooked up or inserted with its side ends at the rack or receivers attached thereto.

When the front side of a level is closed entirely or partially by a storage front plate the price sticker in particular the entire price sticker unit is typically arranged behind the storage front plate.

By the same token at least a rear transversal rod can extend between the rear upright profiles of the frame in lateral direction as an element of a rear price sticker unit, thus advantageously respectively at an elevation so that the rear transversal rod is arranged in front or slightly below the rear narrow side of the divider element, e.g. a storage dish.

At this rear transversal rod in turn a rear price sticker holder is attached which typically extends over and entire width of the back side into which price stickers are insert able from above which price stickers are primarily used for informing the operator in particular when filling the dispensing shelf. The transversal rod is thus bolted down or also only hooked up or inserted at a back side of the rack or at receivers attached thereon.

The individual elements of the rear price sticker unit can thus be configured differently from the individual elements of the forward price sticker unit.

Advantageously the lowest of plural rear price sticker units which is typically on or below the lower narrow side of the lowest divider element includes a ramming production protruding backward beyond the price sticker holder and provided for example in the form of a stop bar in order to prevent cleaning tools like e.g. a broom from hitting when cleaning the floor.

The stop bars for the divider elements extending in the depth direction include a flat top side at least in partial portion of its transversal extension to apply an edge of a divider element wherein the divider elements extend in the transversal direction by different distances above the contact bar in outward direction, at the most however to the outer edge of the rack.

Thus, the contact bars can have a pressure sensor which reports a contact pressure which is caused by the divider element arrange thereon to a control which puts out a signal when a certain minimum contact pressure is under cut as a function of a type and weight of the divider element used in order to request products to be refilled on the divider element by the operator.

A light bar extending in the depth direction is often arranged at the bottom side of the contact bar, wherein the light bar illuminates the products arranged in the storage space disposed thereunder, wherein the light bar advantageously includes LEDs configured as illuminants. In order to be able to remove contaminations of the contact bar easily the contact bar is advantageously configured as a profile with a cross section that is open towards the outside.

In case the retrieving person shall not be able to grip the products directly by hand but with a tool like e.g. gripping tongs or a pusher or a spoon, a tool holder is attached at the rack where the tool can be dropped off.

Thus the tool holder is advantageously made from two horizontally offset upward open hooks including only one very small contact surface, in particular a contact surface that has a rounded or roof shaped cross section in order to prevent contaminations, in particular crumbs falling off from the product from accumulating thereon which is different from a concave contact surface.

The tool is advantageously movably connected with the tool holder, for example with a thread or steel cable and the tool holder is advantageously attached at the rack so that it can be dismounted easily, in particular adhering with only magnets.

The upright profiles advantageously have height adjustable placement bases that their lower ends typically with a threaded rod at whose lower end a base plate is arranged which is elevation adjustable by threading into and out of a respective inner thread in the bottom side of the upright profile in order to be able to position the output shelf exactly vertically also on uneven ground.

Since in particular this open accessible portion of the external thread contaminates easily the lower portion of the upright profile is enveloped by a circumferentially extending upright protective sleeve which is shaped so that its inner free space in a lower portion is greater than the foot plate and also greater than the outer circumference of the upright profile so that on the one hand side the protective sleeve contacts the ground about the base plate and thus prevents contamination of the threaded rod, and on the other hand side extends in elevation into the portion of the upright profile even when the threaded rod is threaded out to its maximum.

For cleaning the ground the protective sleeves can be moved upright provisionally in a very simple manner and then the ground can be cleaned up to the base plates.

A protective sleeve of this type can be used by doubling its inner free cross section relative to the inner free cross section when receiving only one base stand for form locking connection of two dispensing shelves that are arranged directly adjacent to each other in that the two adjacent upright profiles that are adjacent to each other and moved closely together of two adjacent dispensing shelves including their base stands fit in.

With respect to the rack certainly different dimensions with respect to height, width and depth are feasible, in particular however racks with different width are also useable for different purposes.

Thus a rack with smaller width, a retrieval frame can be placed next to a rack with greater width, a storage frame and when the divider elements in both frames are approximately mounted at the same elevation the floors or compartments between the divider elements that are arranged on top of each other of the wide rack can be used as storage spaces and the floors or compartments between the divider elements that are arranged on top of each other of the narrow rack arranged adjacent there to can be used as retrieval spaces.

In this arrangement the front sides of the storage spaces are closed firmly and advantageously almost entirely by storage front plates and are prefer ably not openable by the retrieving person and the natural transparent storage front plates only include a tool opening through which for example a handle of a tool, for example of a pusher can extend by which a retrieving person can push a product from the storage space into the retrieval space that was at the same level wherein the retrieving person can reach in from the front side to retrieve the product.

In this case a back reach protection device can be provided between the adjacent storage frame and the retrieval frame wherein the back reaching protection facilitates a sliding of the product from the storage space into the retrieval space but not into the opposite direction and also in the opposite direction no reaching of the retrieving person from the retrieving space into the storage space is possible.

The rack is furthermore configured with electric conductors which facilitate power supply to the light bars on the one hand side and to optionally provide typically electrically operated heating plates or cooling plates on the other hand side. The power cables are advantageously arranged in an interior of the profiles of the rack which are hollow then or in cable channels that re arranged at the rack and at each rack at least one plug in contact for inserting a power plug or a data plug is provided or both are provided in an integrated manner.

The plug in contact can be part of the power supply which is provided at each rack and advantageously disengage ably attached in particular at or proximal to one of the rear upright profiles or transversal profiles of the rack.

The dispensing shelf can also include sensors, in particular temperature sensors which can be arranged in particular at the rack and/or at the bottom side of one of the divider elements and/or at a back plate closing the back side.

With respect to the kit the object is achieved in that the kit in its basic shape includes at least one configuration of a rack and at least one first configuration of an approximately horizontal storage dish and additionally at least a first embodiment of a storage front plate and a base front plate.

Already with this basic kit the dispensing shelves can be put together which all have a rack with identical shape but which can be configured on the front side, in particular in the storage portion either completely open or with the first embodiment of the storage front plate completely or partially closed. Also the base portion can be optionally open on the front side or entirely or partially closed by the base front plate.

Additional elements in the kit facilitate in spite of few additional elements to massively increase the number of the variants of the dispensing shelves to be produced.

Different additional embodiments of the storage front plate configured as additional elements of the kit which for example include a greater or smaller retrieving opening than the first embodiment of the storage front plate and/or as a H-shaped transition front plate which extends in elevation in more than one storage space or as a front flap facilitates additional variants of the front configuration of the dispensing shelf.

An second embodiment of the rack which for example has the same contour and size in a side view but is narrower or wider in front view than the first embodiment facilitates arranging racks with different width in series and using them with different purposes, for example a wide rack with storage spaces arrange above one another and with an essentially closed front side configured as a storage rack and the narrow rack arranged adjacent there to with retrieval spaces that are arranged approximately at the same elevation and which include essentially include a completely open front side in the retrieving portion as a retrieving rack.

The kit can also include different embodiments of a rack which are configured for different functions thus for example a cooling rack can be provided which is configured to receive a cooling module like a refrigerator with a partially open front surface in order to present cooled products therein.

By the same token a bread cutting rack can be provided which is configured to receive a self-service bread cutting machine in which a buyer of bread can cut a loaf of bread himself.

Also the cooling module and/or the bread cutting machine itself can be components or the kit.

Permanently mounted side plates forming additional elements of the kit can be used to close side surfaces of the rack as required. Depending whether a concatenation of racks is used or not and the storage spaces or retrieval spaces of the racks shall be separated from each other or not.

An alternative separation is provided by the back reaching protection device forming an additional element of the kit which can be arranged between a storage space and a retrieval space arranged adjacent thereto approximately at a different level and which prevents a displacement of products and also of a hand of a user from the open accessible retrieving space into the storage space.

Through contact bars forming additional elements of the kit which can be attached at the rack extending approximately in depth direction the divider elements like e.g. the storage dishes can be placed onto the contact bars instead of being placed onto the struts of the rack and the contact bars can be attached at the desired positions at the rack.

When contact bars with different lengths are provided in the kit that are adapted to a desired slant angle and elevation position in the rack defined inclined positions of the divider elements resting thereon, like e.g. storage dishes can be facilitated.

As additional elements the kit can also include light bars which are attachable at the rack, in particular at a bottom side of the contact bars.

Furthermore an embodiment of the contact bars can form a portion of the kit wherein the embodiment includes a pressure sensor to determine a weight that loads the contact bar and which is caused by the divider element resting thereon which provides an indication of the loading condition of the divider element with a corresponding processing through a control which then also forms a portion of the kit.

When the kit includes a forward price sticker unit, in particular including a forward transversal rod that is engage able at the rack and a forward price sticker holder that extends in width direction and that is attachable at the forward transversal rod price stickers can be arranged in a simple manner at a level of each divider element and replaced as required.

By the same token a rear price sticker unit that is configured completely or partially analogous to the forward price sticker unit can be used for attachment at the back side of the rack and can be a component of the kit.

When additional embodiments of divider elements are available in the kit, for example beyond one or plural embodiments of storage dishes also a heating plate or cooling plate product can be additionally heated or cooled in the dispensing shelf.

When the kit includes a hinge and/or a closing damper or contact damper in particular the storage front plates and/or base front plates can be pivot ably attached at the rack and simultaneously an excessively hard stop at the rack is prevented during closing.

Advantageously the kit then also includes a closing device, in particular a locking bar device or a magnet for supporting the move able storage front plate in the closed position at the rack.

Through additional elements like e.g. a tool holder which can be attached at the rack, in particular magnetically attached the required tool, thus a pusher or a spoon can be stored for the user.

When a base front plate with a pass through opening is provided in the kit this can be used differently also when a recycling material container or a paper bag holder or a disposable glove holder which fit behind the pass through opening is included in the kit and attach able behind the pass through opening. The recycling material container can also be a container that is placed separately onto the ground behind the base front plate and directly under the pass through opening or attached at the back side of the base front plate, in particular a tub or box.

Advantageously the kit also includes a rack in which insertion openings are arranged for inserting additional components for the dispensing shelf wherein the kit advantageously also includes cover elements which cover the insertion openings when not in use in order to prevent objects from falling in and users from being hurt.

Advantageously the kit also includes a rack wherein a respective elevation adjustable support base is provided at a bottom side of the rack, in particular at lower ends of the upright profiles of the rack.

Advantageously the kit also includes a protective sleeve for receiving and enveloping a single support base and/or a connecting sleeve for receiving e.g. two racks that are positioned directly adjacent to each other.

An additional element of a kit can be a tool holder which is attachable at the rack and which provides a tool like a pusher or a spoon or a pair of tongs to the retrieving person.

c) EMBODIMENTS

Figure 1B:
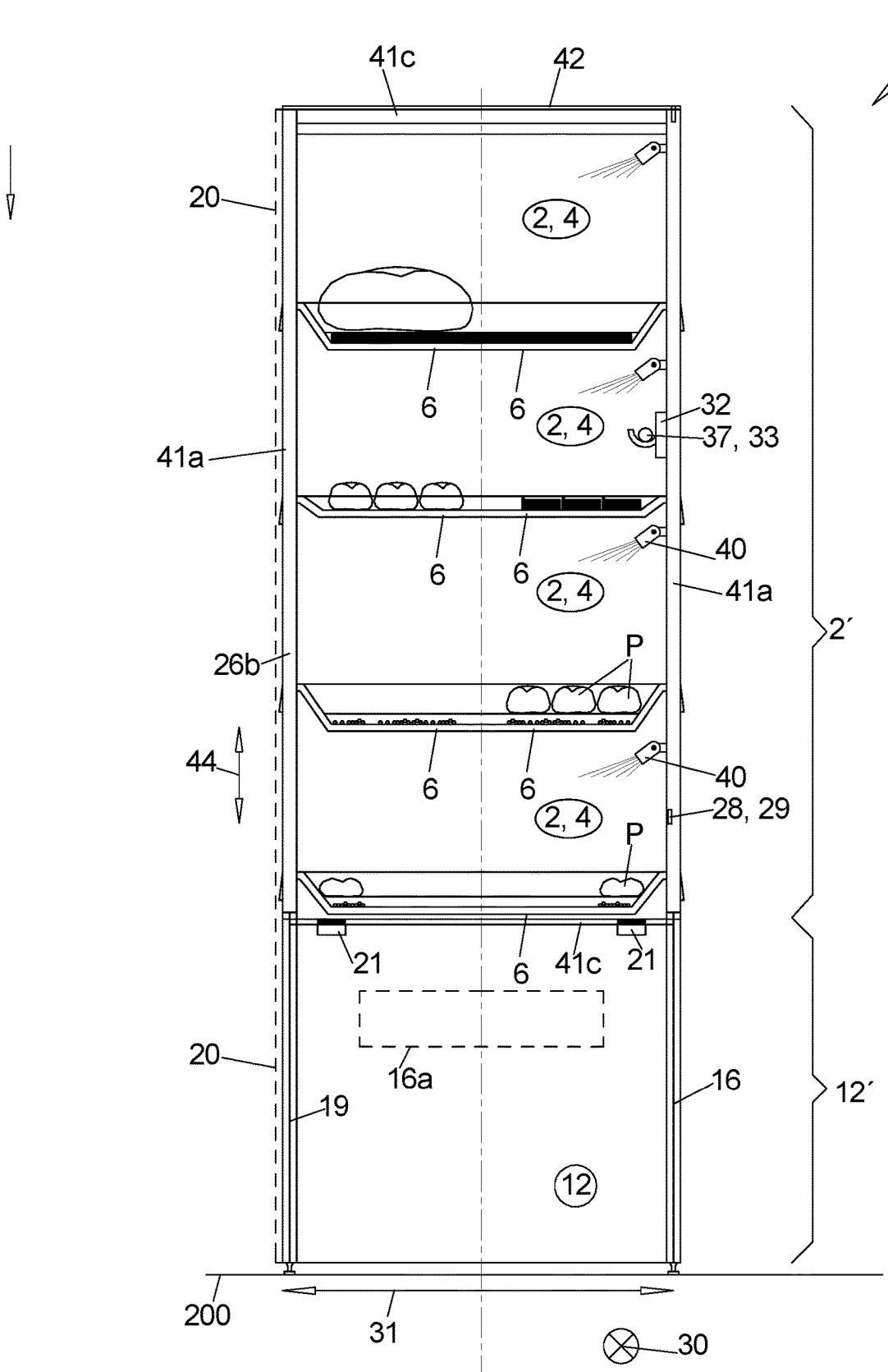
Figure 2A:
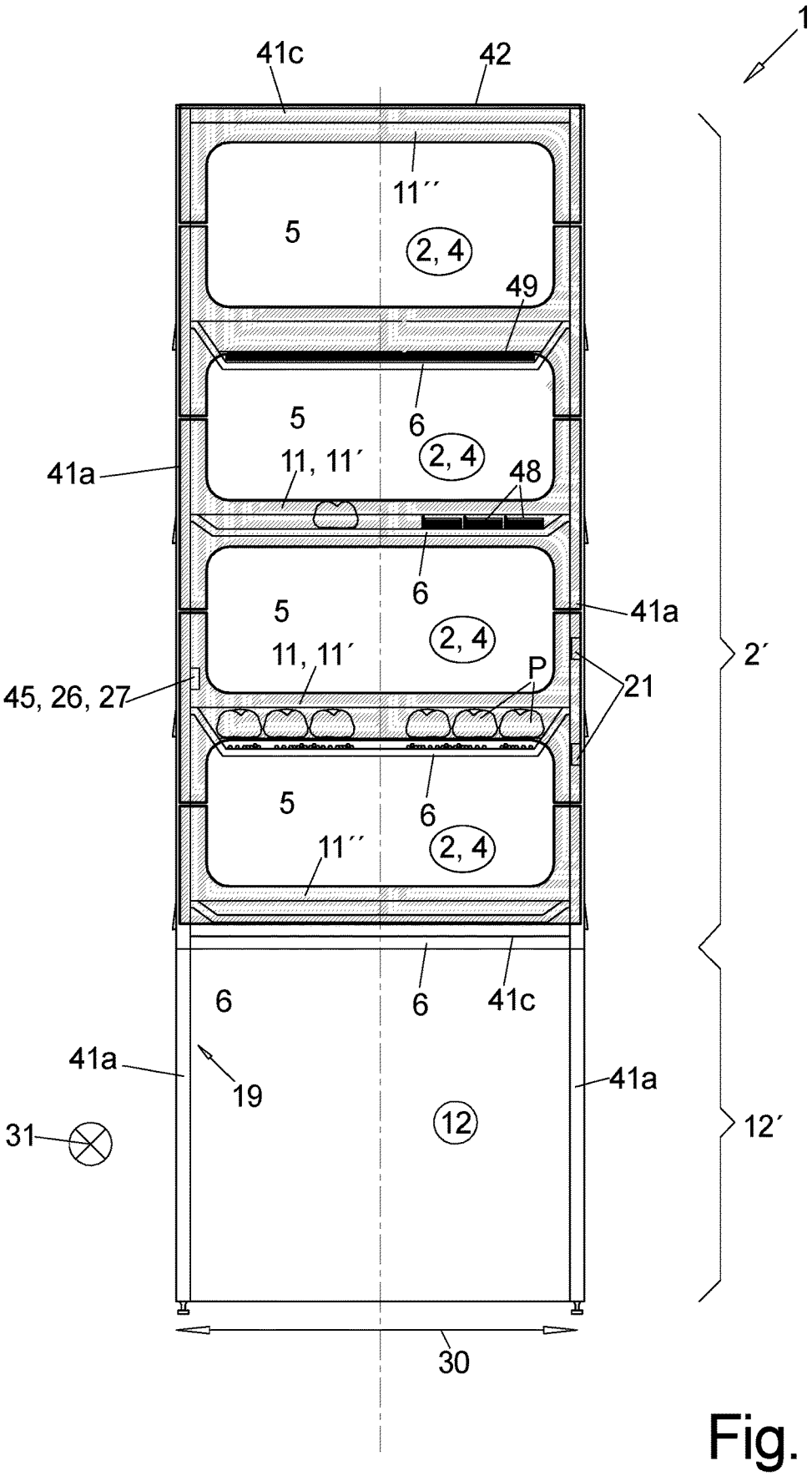
Figure 2B:
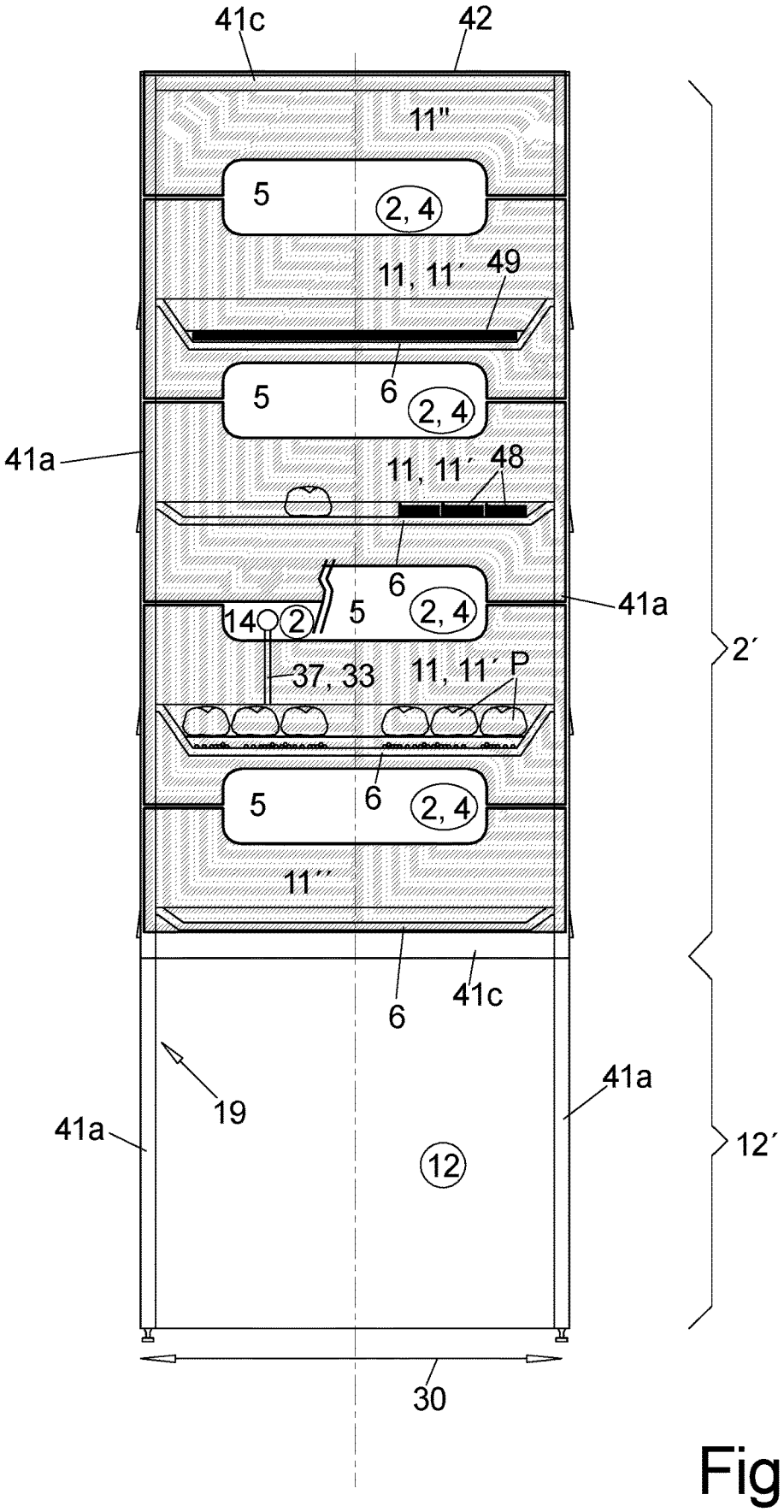
Figure 2C:
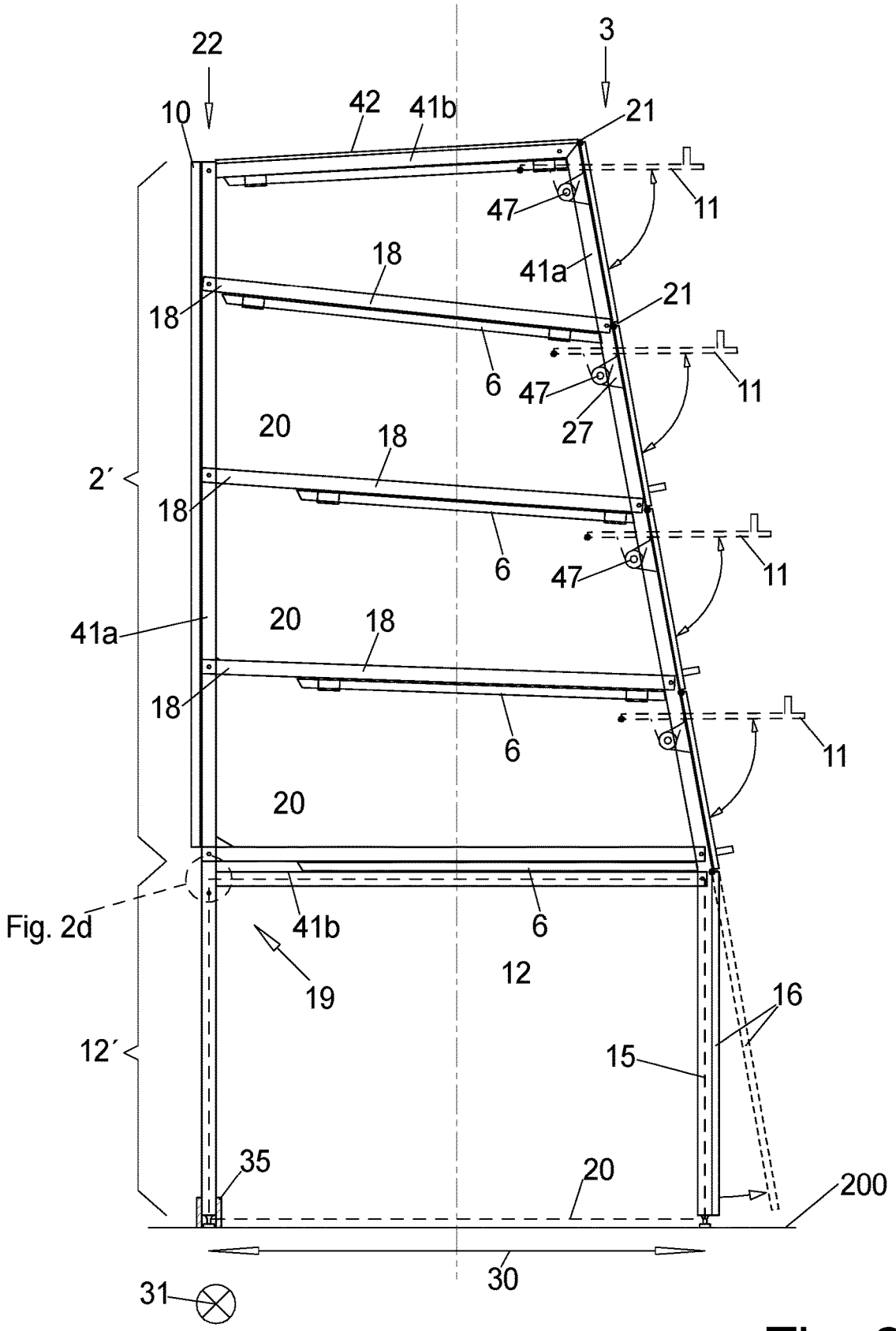
Figure 2D:
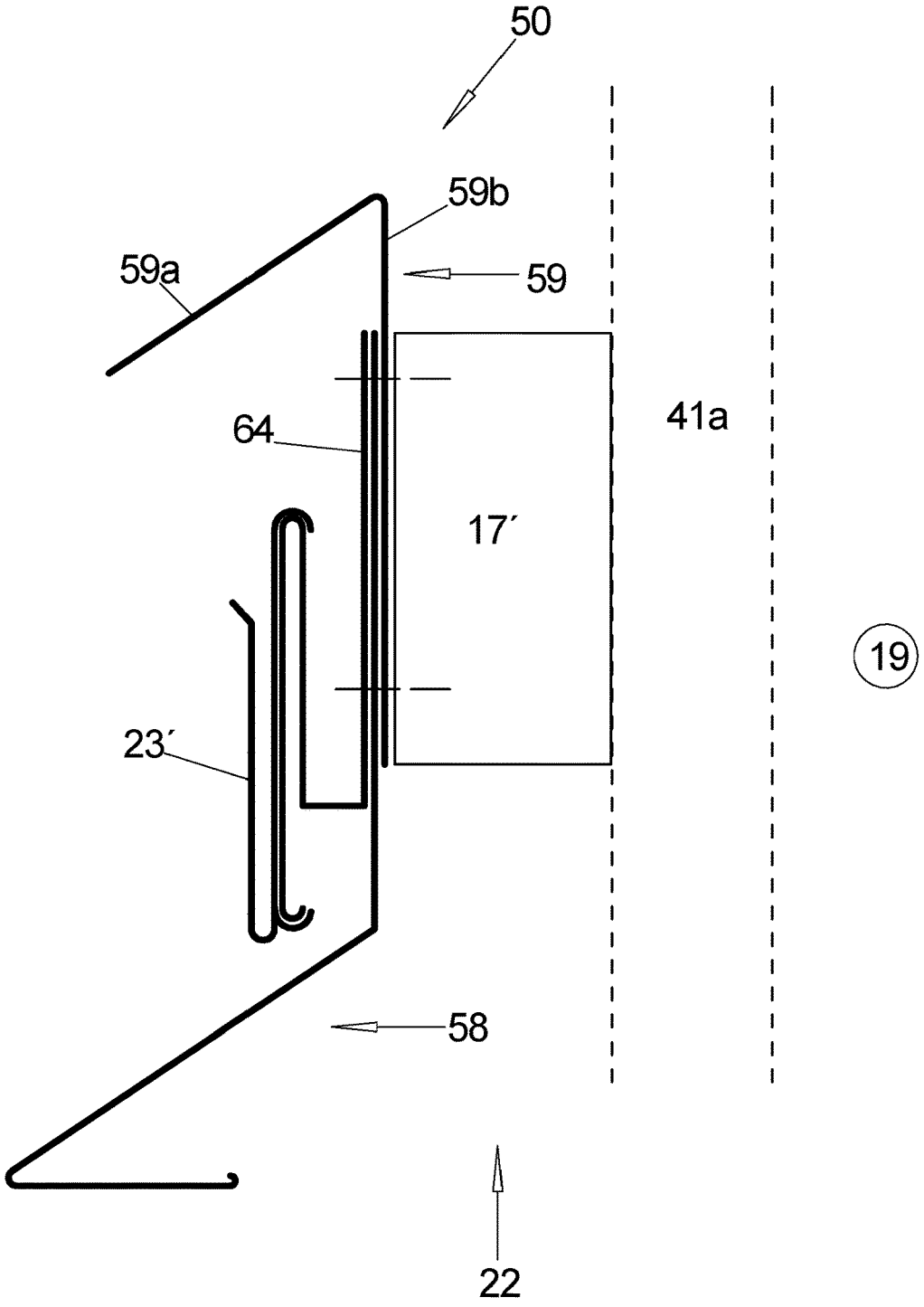
Figure 3A:
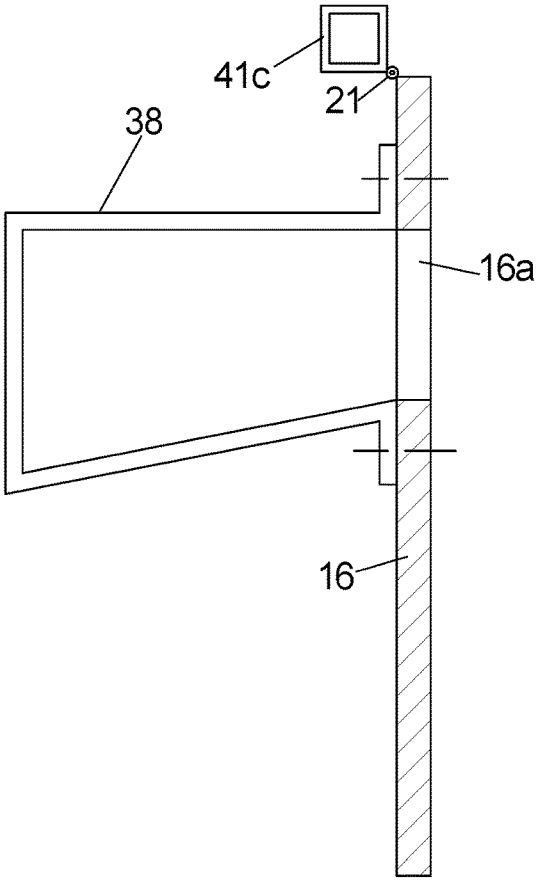
Figure 3B:
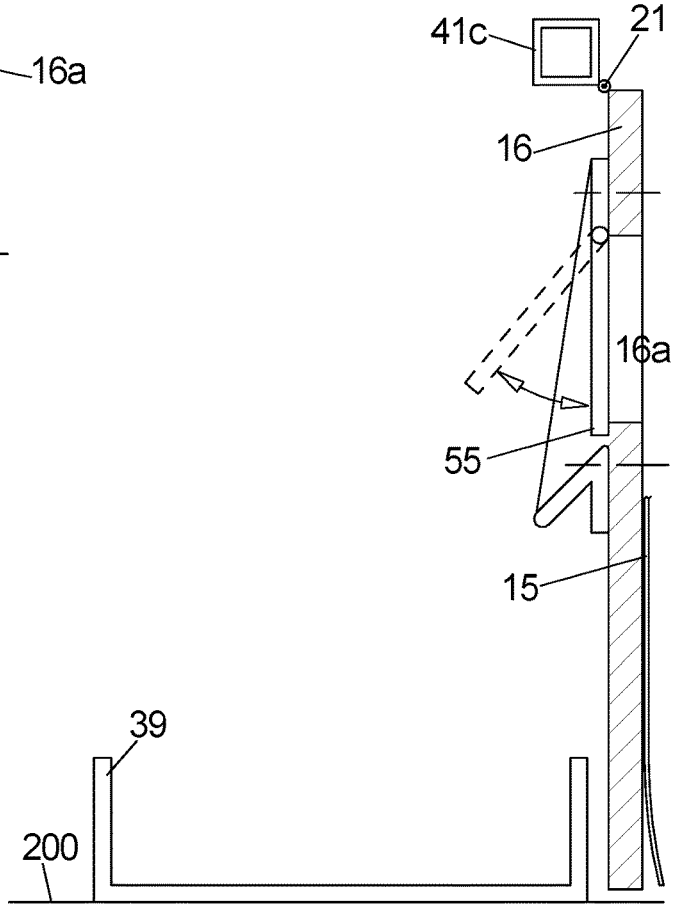
Figure 3C:
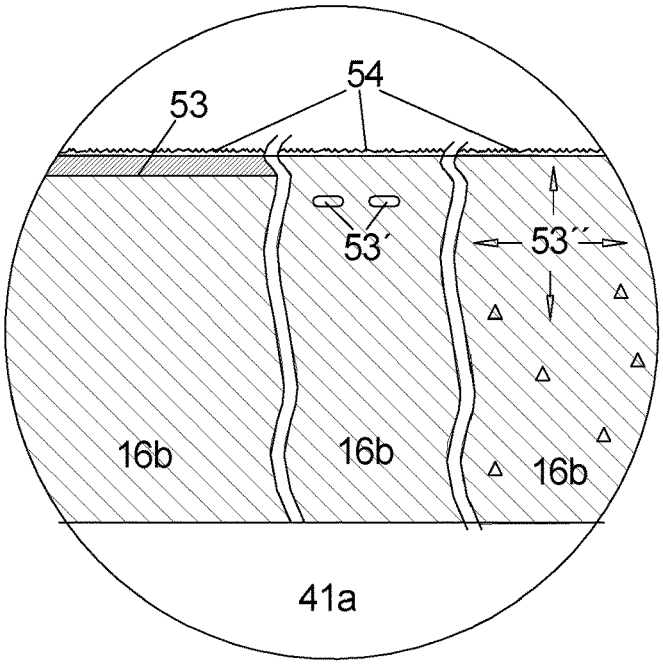
Figure 4A:
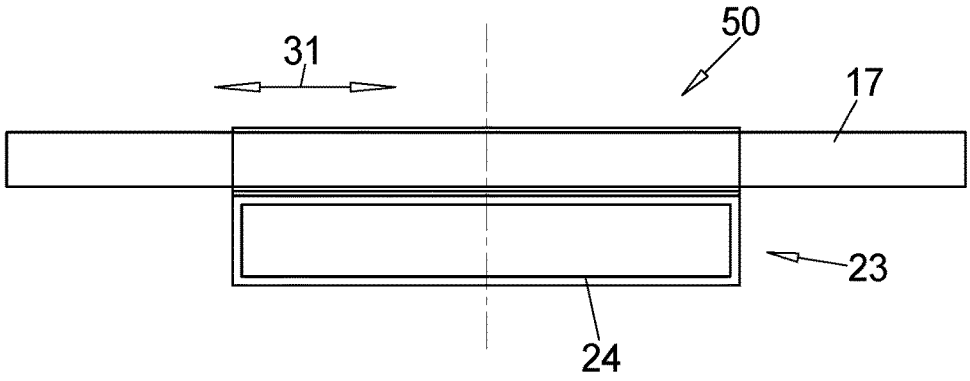
Figure 5A:
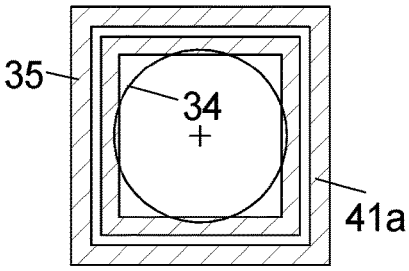
Figure 5B:
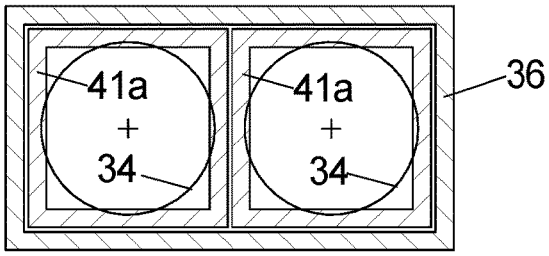
Figure 6A:
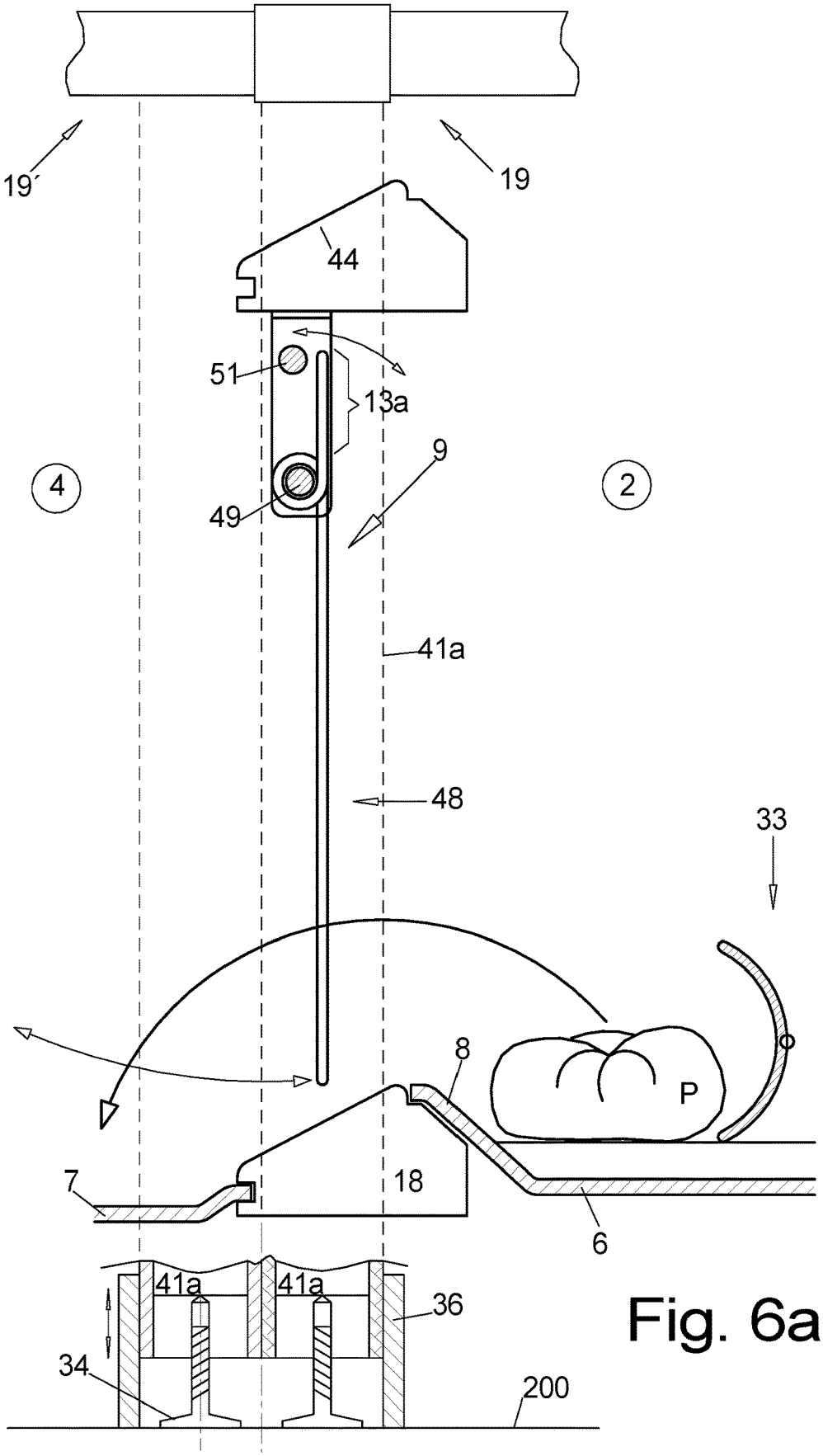
Figure 6B:
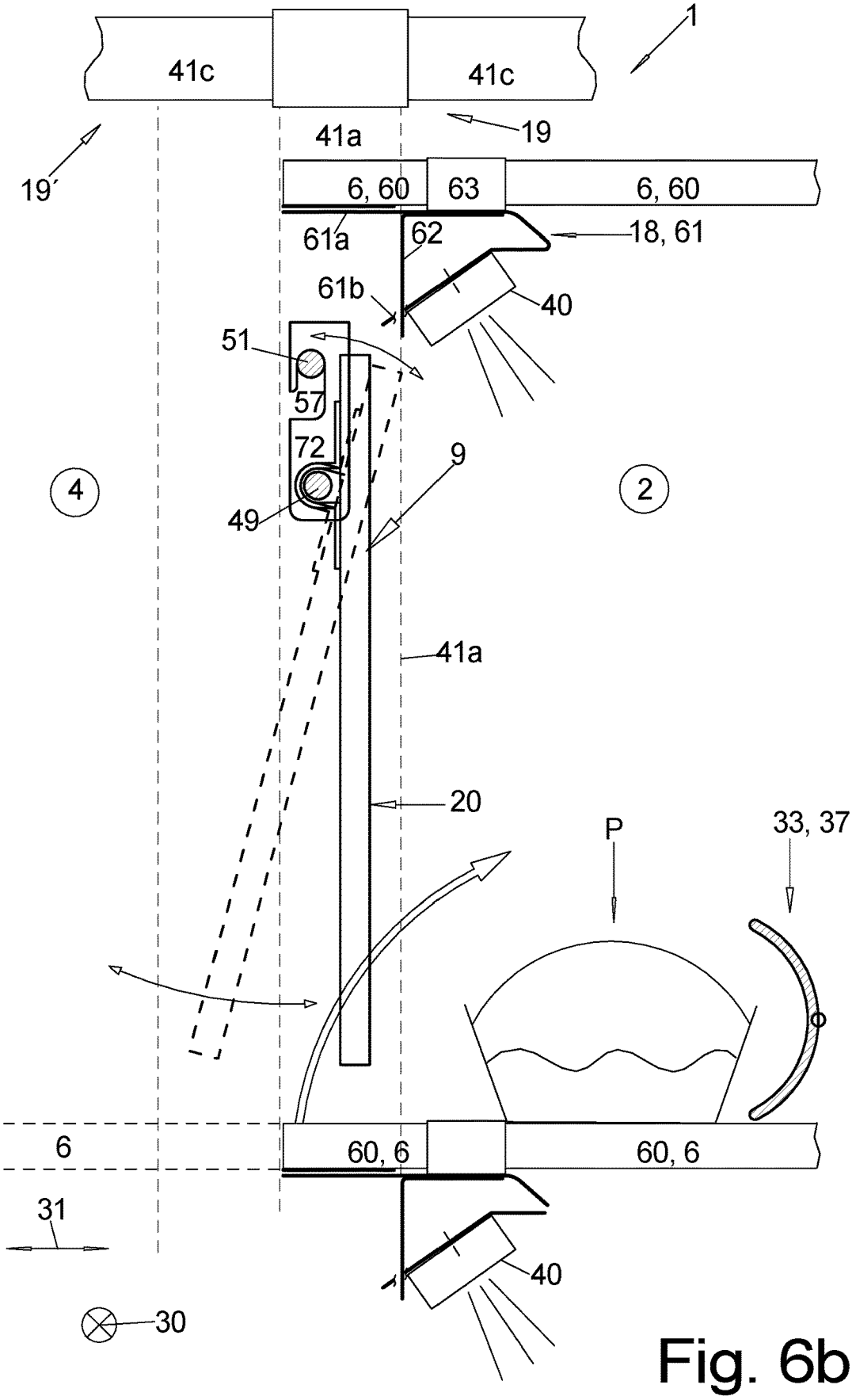
Figure 7A:
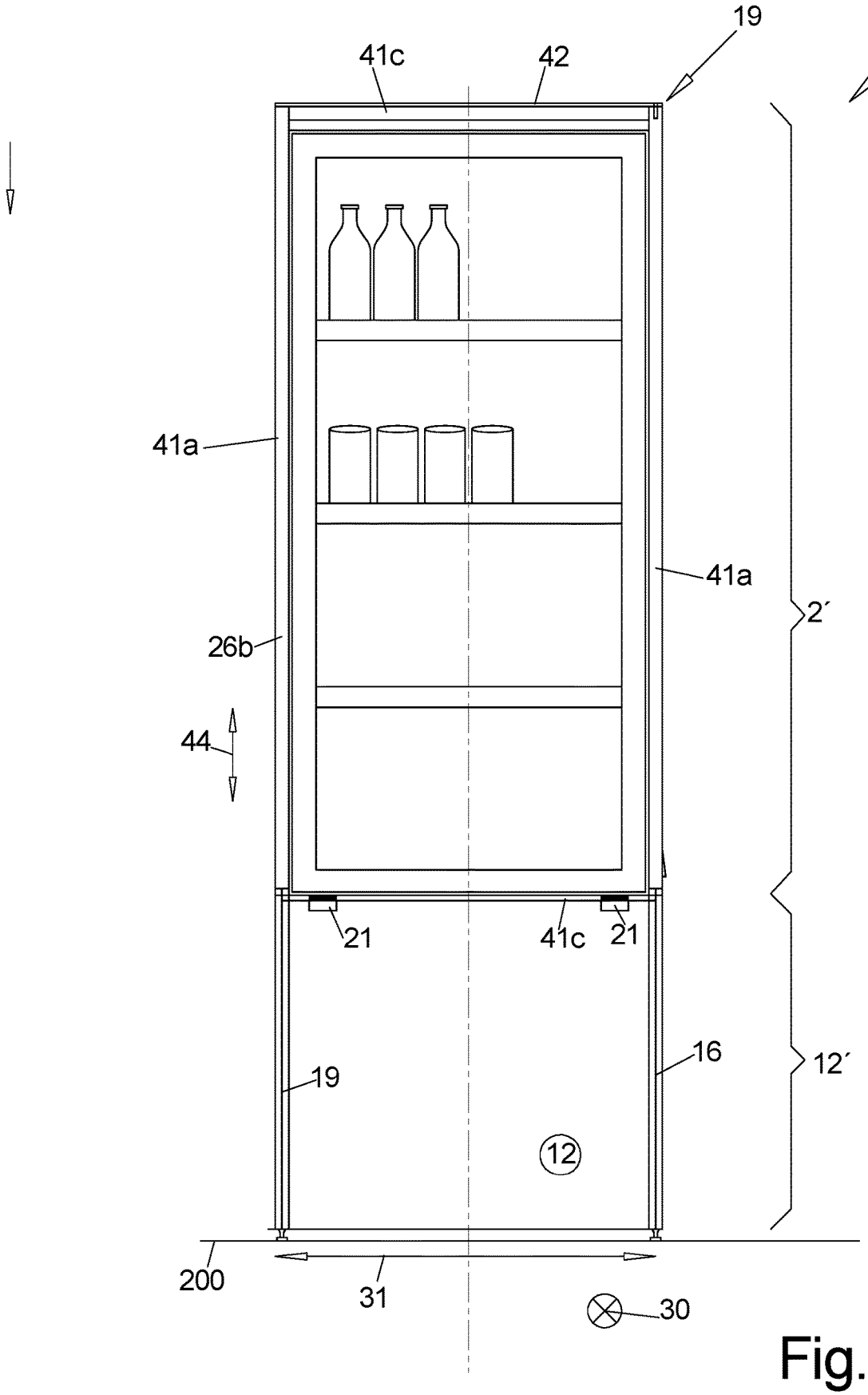
Figure 7B:
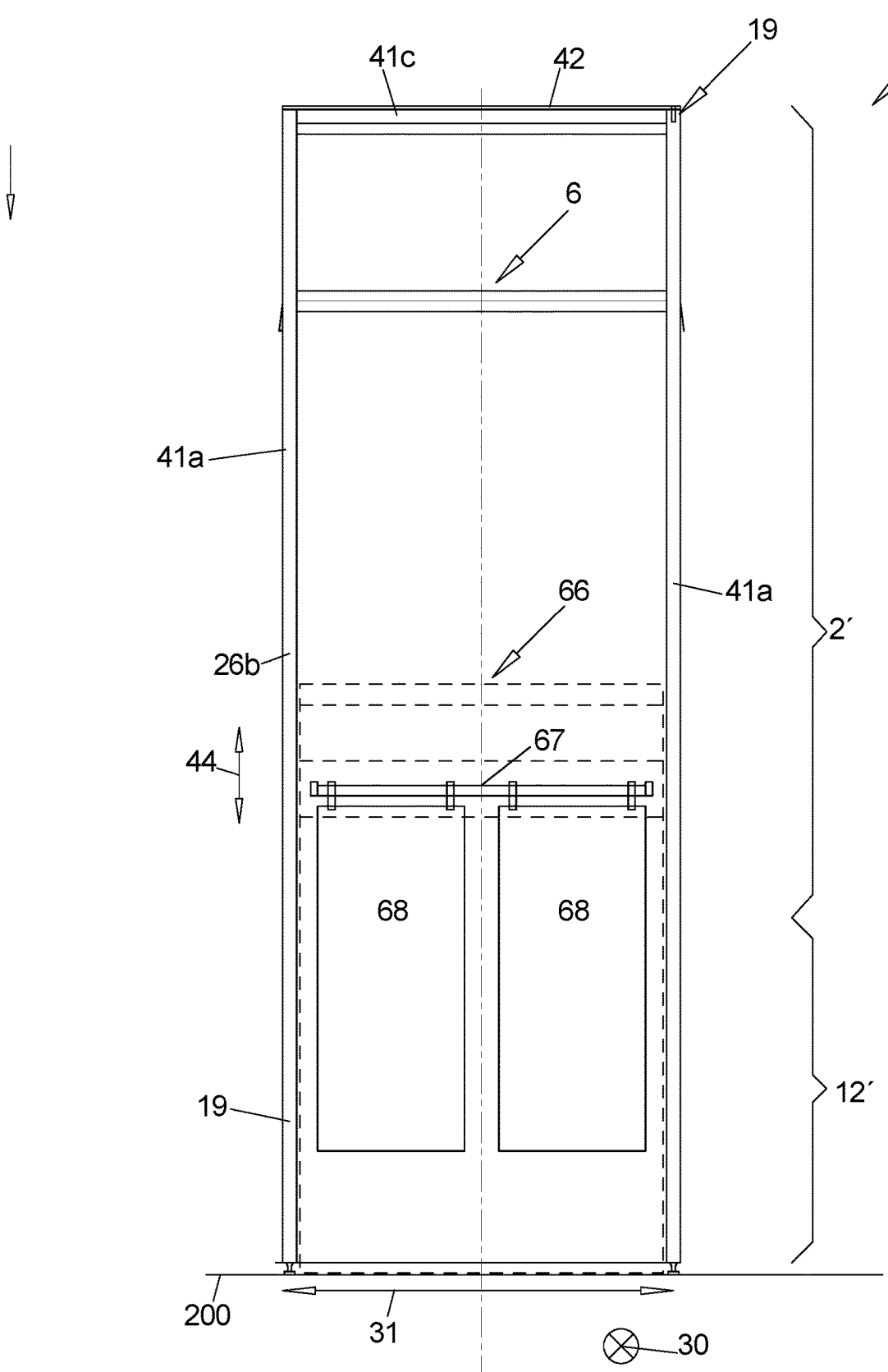

Embodiments of the invention are subsequently the invention is described in more detail with reference to drawing figures, wherein:

FIG. 1*a* illustrates the dispensing shelf in the side view, thus viewed in width direction with a first embodiment of the rack;

FIG. 1*b* illustrates the dispensing shelf in the front view, thus viewed in depth direction from a front in a first front configuration;

FIG. 2*a* illustrates the dispensing shelf in the front view like according to FIG. 1*b* in a second front configuration; n a center position of the bailing press;

FIG. 2*b* illustrates the dispensing shelf in the front view according to FIG. 1*b* in a third front configuration;

FIG. 2*c* illustrates the dispensing shelf in the side view according to FIG. 1*a* with a fourth front configuration;

FIG. 2*d* illustrates a rear price sticker unit viewed in the transversal direction;

FIG. 3*a, b* illustrates the base front plate in different embodiments;

FIG. 3*c* illustrates a sectional view through the base front plate or a lateral protective plate;

FIG. 4*a, b* illustrates a forward price sticker unit in front view and in side view;

FIG. 5*a, b* illustrates a protective sleeve and a connection sleeve connectively in top view;

FIG. 6*a* illustrates a back reaching protective device;

FIG. 6*b* illustrates a pivot able side wall also for use as a back reaching protective device;

FIG. 7*a* illustrates a first special shape of the rack, wherein the dispensing shelf includes a cooling module; and FIG. 7*b* illustrates a second special shape of the rack, wherein the dispensing shelf includes a bread cutting machine.

FIG. 1*a* illustrates a side view and FIG. 1*b* illustrates a front view of an individual dispensing shelf 1 with a first embodiment of the rack which shows that the dispensing shelf 1 has a rack 19 which is made from profiles 41 that are welded or bolted together namely made from vertically extending upright profiles 41*a*, depth profiles 41*b* extending in the depth direction 40 and transversal profiles 41*c* extending in the width direction 31, the transversal direction.

A second embodiment of the rack 19' as illustrated in FIGS. 6*a, b* can be wider or narrower in the front view according to FIG. 1*b*.

This way a rack 19 is provided which is rectangular in the front view, thus provided with parallel extending left and right upright struts 41*a* and horizontally extending depth struts 31*b* and transversal struts 41*c*.

The transversal profiles 41*c* which extend between the rear and front vertical profiles 41*a* are only provided at high elevation at the upper end and in the lower half, thus approximately at one third of the entire height of the dispensing shelf 1 which is approximately the height of a person so that the lower transversal profile 41*c* is approximately at knee height of an adult user 100 standing in front of it or slightly above.

It is also evident from the side view of FIG. 1*a* that the depth profiles 41*b* are also only provided at two locations, namely between the upper ends of the forward and rear upright profiles 41*a* and approximately at an identical elevation as the lower transversal profile 41*c* in FIG. 1*b*.

In the side view a depth profile 41*b* can additionally also provided at the other ends of the sides, thus of the front and rear upright profiles 41*a*. However an additional transversal profile 41*c* is not provided at a level of the lower ends of the upright profiles 41*a* as evident from FIG. 1*b* in order not to prevent accessibility from a front between the upright struts 41*a* in a lower portion slightly above the base.

The side view of FIG. 1*a* illustrates that the rack 19 is overall not rectangular but has a vertical front side 3 only in the lower portion, thus up to a lower of the two depth profiles 41*b*, whereas upward from there and thus the greatest portion of the front side 3 is configured inclined, thus the forward upright profile 41*a* in this portion approaches in the upward direction to the rear continuously vertical upright profile 41*a*.

Furthermore the upper most depth profiles 41*b* connecting the upper ends of the upright profiles 41*a* do not extend horizontally but slightly downward sloping from the front side 3 to the back side 22 of the rack 19. This upper side of the dispensing shelf 1 is closed by a cover plate 42 that is applied to the rack 19 from above.

The front side 3 of the rack 19 in front of which the user 100 stands and wishes to retrieve products P from the dispensing shelf 1 can be completely open or more or less closed as described infra and also the side surfaces can be open or closed. The back side 22 from which the dispensing shelf 1 is typically filled with products by the operator is either open or closed by doors or flaps to be opened as will be described infra.

Above the lower depth profile 41*b* and the transversal profile 41*c* contact bars 18 are attached at the upright profile 41*a* at different levels between the left upright profile 41*a* as well as the right front and rear upright profile 41*a* on a left side and on a right side at the same level, typically bolted down wherein divider elements 6 typically storage dishes 6 for products P to be deposited and sold are placed with their edges onto the contact bars 18 as illustrated in FIG. 1*b* in a sectional view.

The contact bars 18 and thus the divider elements 6 are therefore arranged slanted downward from the back side 22 to the front side 3 thus from the uppermost contact bar 18 to the lower most contact bar 18 with decreasing slope, wherein the lowest contact bar 18 can also be arranged horizontal as illustrated in FIG. 1*a*.

As illustrated in FIG. 1*b* the divider elements configured as storage dishes 6 can be shaped differently, in particular they can have different dimensions in the vertical 44, thus they can be configured more or less flat, among other things dependent therefrom which products, for example rolls, pretzels or an entire bread loaf shall be stored therein.

Thus, the divider elements 6 divide the interior space of the dispensing shelf 1 in elevation which provides individual storage spaces 2 for the products P, namely between the individual divider elements 6 and between the upper most divider element 6 and the upper end of the rack 19 of the dispensing shelf 1 thus typically the cover plate 42.

The portion below the lowest storage dish 6 is designated as base space 12 so that the interior of the dispensing shelf can be elevation divided into a storage portion 2' and a base portion 12'.

The front side 3 is closed in the base portion 12' by a front plate 16 which however can be opened in that the front plate 16 is openable and configured as a flap and attached pivot able upward at its upper edge by one or plural hinges 21 at the rack, in particular the lower transversal profile 41*c*.

In open condition this facilitates access to the base space 12 from the front either to clean the underground 200 or to store supplies at this location. The closing process is delayed by a closing damper.

In or at the front plate 16 as illustrated in FIG. 3*a, b* functional elements can be arranged in particular at a back side of the front plate.

For this purpose the front plate 16 in particular in its upper half includes an advantageously horizontally extending pass through opening 16*a* wherein a box shaped element is attached on a back side of the base front plate 16 according to FIG. 3*a* with its open front side aligned with the pass through opening 16*a* which is used for example as paper back box 38 for which the user 100 can retrieve a paper bag for inserting the products P.

For this purpose the paper bag box 38 includes a slightly downward backward sloping plate so that the bags stored thereon cannot slide out in forward direction by accident but which ends at a level of the lower edge of the pass through opening 16*a* for slightly below.

By the same token according to FIG. 3*b* the pass through opening 16*a* can be used as an in feed opening for products P that would have be fallen on the ground before or torn paper bags. The recycling container 24 can be configured as a simple box standing on the ground, whereas an inward pivot able plate 55 is arranged at the back side of the base front plate 16 above the pass through opening 16*a* and a slide 56 that is slanted inward downward is arranged at the bottom edge of the pass through opening 16*a* and in particular both together are provided at the frame enveloping the pass through opening 16*a*.

The recycling container 24 in case it is attached at the base front plate 16 is advantageously easily dismountable from the back side of the base front plate 16, in particular engage able and disengage able in order to facilitate emptying the full waste container 24.

In FIG. 3*b* a magnet foil 15 is furthermore illustrated on the front side of the base front plate 16 wherein the magnet foil 15 is subsequently described in a context with FIG. 3*c*.

As illustrated in FIG. 1*b* at the left side of the dispensing shelf 1 the sides of the dispensing shelf can be closed when required on one of the two sides with a lateral protection plate 20 as required either only in the base portion 12' or also in the storage portion 2' which among other things is a function of plural such dispensing shelves 1 are arranged adjacent to each other in the front view of FIG. 1*b* and/or whether the storage spaces 2 arranged adjacent to each other have to be separated from each other or not.

This is among other things a function of storage dishes 6 being used as divider elements or divider elements with another function, for example heating plates for heating products or cooling plates for cooling products. Then an affected storage space 2 has to be closed on all sides possibly already for reasons of thermal insulation.

FIG. 1*a* illustrates a power supply 43 as can be attached for example at one of the upright profiles 41*a*, in particular also in the base space 2 in order to supply consumers with power like e.g. a heating plate configured as divider element 6 in that a cable leading away from the heating plate can be plugged into the power supply unit 43 with a corresponding plug.

Feeding electrical conductors to the power supply 43 can be performed in particular through the profiles configured as hollow profiles, in particular hollow rectangular profiles in particular the upright profiles 41*a* or through simple cable channels that are attached there to but not illustrated.

Depending whether viewing in particular into the storage spaces 2 shall be facilitated from a side the lateral protection plate 20 in the storage portion 2' can be configured transparent in particular as a glass pane whereas the lateral protection plate 20 in the base portion 60 is typically made from a non-transparent material typically from the same material as the base front plate 16.

In case of non-transparent plates like in case of the base front plate 16*a* and the lateral protection plate 20 in the base portion 2' the plates shall have a coating made from a natural material or material with a natural appearance for optical reasons, in particular with wood portions, for example a paper material.

FIG. 3*c* illustrates a cross section through the base front plate 16 in a blown up view.

The base front plate 16 is made from a core plate 16*b* which provides sufficient stability and a very thin coating 54 applied to an outside of the core plate, in particular from a side that is opposite to the attachment side at the rack 19. This coating 54 shall have the appearance and the touch of a natural material, advantageously wood or paper since advantageously natural products like baked goods or fruit or vegetables are displayed on a presentation furniture piece of this type.

The touch is determined among other things by heat conductivity since a metal surface as well as most plastic materials have a different thus higher heat conductivity than a surface from a wood material and therefore the coating 54 is made from a wood material or paper material and has a fine 3 dimensional surface structure and/or a lower temperature conductivity compared to wood and therefore feels natural.

Still a magnetic foil 15 shall be configured to adhere from time to time to the typically provided coating in order to apply information and pricing at short notice at the base front plate 16 wherein the information or pricing is provided on an imprinted metal foil.

In the illustration of FIG. 3*c* plural options are provided for this purpose.

In the left portion of the figure a metal plate 53 thus a piece of magnetizable sheet metal is applied to the core plate 16*b* and the coating 54 made from a wood material or paper material is only applied to the outside of the sheet metal. Since this coating is typically rather thin a strong temperature conductivity of the metal plate 53 arranged there under is still partially perceivable so that the desired touch may not be achieved completely.

In the solution illustrated in the center portion magnetizable metal wires 53', for example a metal grid are integrated in the core plate 16*b* which typically already has to be performed during production, thus offset from the outer surface of the core plate 16*b*. This does not influence the low temperature conductivity of the core plate 16*b* which is typically also made from a wood material and which is typically a particle board.

In the right portion of the figure a plurality of magnetizable metal particles 53" is added to the material of the core plate 16*b* which facilitates production in particular when the core plate 16*b* is configured from particle board.

In particular when there is an individual dispensing shelf or plural dispensing shelves 1 that are identical and arranged in series according to FIG. 1*b* the storage spaces 2 in which the products P are placed on the divider elements in particular the storage dishes 6 simultaneously form the retrieval spaces 4 since a user 100 standing in front of it will reach through the front side 3 into the corresponding retrieval space 4 and will grip the desired product P and retrieve it.

The front side 3 can be configured quite differently in particular in the storage portion 2' among other things as a function of hygiene regulations that are in force at a set up location of the dispensing shelf 1 for food products that are offered unpackaged like e.g. in particular baked products.

Thus FIG. 1*b* shows a solution in which the front side 3 is completely open in the storage portion 2' and a user 100 can reach in without any obstacle and can grip and retrieve a product with his hand 101.

Due to the completely open side 3 products P can fall from the divider element 6 relatively easily, in particular when the divider element 6 is not a storage dish with a recess but a flat plate and the products can fall out in front and drop onto the contaminated underground 200 or germs can transition from the user 100 onto products P placed in the storage space 2, for example when the user sneezes.

In order to reduce these risks FIG. 2*a* also illustrates a solution in the front view where the front side 3 in the storage portion 2' closes a small portion of the front side 3 by front plates 11 which are configured in this case as at least partially transparent front panes 11, so that a retrieval opening 5 is respectively created at a level of each storage or retrieval space 2, 4 wherein the retrieval opening 5 is enveloped by the storage front plate 11 forming a frame so that the retrieval opening is slightly reduced in size relative to the entire front surface.

At least a drop out of products in forward direction is thus prevented in that the lower edge of the retrieval opening is respectively positioned slightly above the top edge of the respective divider element, for example the storage dish 6.

The storage front plates 11 illustrated in FIG. 2*a* are also provided in the representation of FIG. 1*a*.

Since the user 100 can reach through the respective retrieval opening 5 into the respective retrieval space 4 it is not necessary for this process for the user to open the front plates 11, but for the operator, for example for cleaning the storage front plates, in particular the storage front plates 11.

For this purpose each of the storage front plates 11 in this embodiment is configured as a door that is pivot able about two hinges 21 that are typically arranged above one another which are only drawn in an exemplary manner at one of the storage front panes 11 but are fixated against pivoting upward at the other side either by the locking mechanism 45 illustrated in FIG. 1*a* that can only be opened from the inside or a magnet 26 that is attached at the front pane 11 with a contact damper 27 between the magnet 26 and the rack 19 at the iron rack 19.

This locking mechanism 45 is arranged at a back side of the storage front plate 11 and is therefore only visible with difficulty for the user standing in front of the front side and is therefore not opened by the user.

As evident in the blown up view of FIG. 1*a* this locking bar mechanism 45 includes a pivot lever that is pivot ably attached at the upright profile 41*a* and includes a locking bar protrusion which penetrates in the locked condition from above into an upward open recess of an opposite element 46 which is attached at a back side of the storage front plate 11.

In order to keep an number of individual storage front plates 11 that need to be stored small the storage front plates 11 are configured in front view as H-shaped transition front plates 11' and arranged with their connecting center bar in an elevation portion of the divider element 6, as recited supra with the upper edge above the upper edge of the divider element or the storage dish 6.

Thus the center reach through openings 5 besides the upper most and lower most level are enveloped by the upper front plate transition plate element 11'*a* of a transition front plate 11' arranged there under and a lower transition plate element 11'*b* of a transition front plate 11' whose free ends of their freely terminating arms are aligned with each other in the upward direction and the gap there between is arranged approximately at half the height of the reach through opening 5.

The transition front plates 11' are respectively configured identical.

Only for the upper most and lower most reach through opening 5 a closure front plate 11' is provided for the upper most and lower most reach through opening 5, for the lower most reach through opening for the frame at the lowest level and for the upper most reach through opening for the frame in the upper most level wherein the closure front plate 11' is U-shaped in front view with the same distance and the same arm width of the freely terminating arms as the transition front plate 11'.

For the frame of the lower portion of the lowest reach through opening 5 the lower terminal front plate 11" is configured U-shaped and for the frame of the upper portion of the upper most reach through opening 5 the upper terminal front plate 11" is arranged as an upside down U thus portal shaped terminating approximately with the upper edge of the front side 3 of the dispensing shelf 1.

FIG. 2*b* illustrates a solution where the reach through openings 5 are configured much smaller so that the products placed behind it in the storage space 2 and the retrieval space 4 are protected much better.

In the corresponding transition plates 11' the lateral freely terminating arms are accordingly configured wider than the connecting center arm and in particular a transition plate 11' of this type can also be configured U-shaped instead of being H-shaped since a bulge only at one of the two horizontal transversal edges of the transition front plate 11' suffices to provide a narrow tool opening 14.

FIG. 2*b* furthermore illustrates only a much smaller and in particular lower tool opening 14 between two adjacent front plates 11 at one location in the left half of the figured instead of a pass through opening 5 which is large enough so that a user 100 can also reach through with a hand 101 holding a product P. Reaching through this low tool opening 14 is also possible only with a tool 37, for example a pusher 33 which can extend through the opening with its handle so that the product P can be handled in an interior of the storage space 2 with the spoon portion or pusher portion that is arranged at the front end of the handle which will be described infra with reference to FIG. 6*a, b*.

FIG. 2*c* illustrates a front side configuration in the side view analogous to FIG. 1*a* wherein the individual storage spaces 2 are completely close able on the front side 3 in the storage portion 2' by individual storage front plates 11 that are configured as flaps.

Each front plate 11 configured as a flap covers the elevation range between two contact bars 18 that are arranged on top of each other or divider elements 6 resting on the separation bar and extending in the lateral direction 31 in a closed condition of the front plate where it contacts an outside of the upright profiles 41*a* parallel to the front surface 3. Each front plate 11 configured as a flap is pivot able about a horizontal pivot axis 47 relative to the rack 19, in particular the two lateral forward upright profiles 41*a* so that it stands still in the open condition at least for a particular time period or can be interlocked.

In FIG. 2*c* furthermore a rear door 10 is illustrated that closes the back side of the dispensing shelf 1, thus of the frame 19 which is independent from the configuration of the front side wherein the rear door extends over the height of the storage portion 2' or is made over the height from one or plural portions or can also be configured in a view from behind as a one pane or two pane rear door.

Independently from the front configuration an optional power supply unit 43 is illustrated in FIG. 2*c* in the base space 2 wherein the power supply unit is advantageously arranged proximal to the front base front flap 16 and typically arranged at the frame 19 and supplies all electrical consumers with power which are provided in the dispensing shelf 1.

FIG. 6*a, b* shows solutions with a respectively adjacent storage space 2 and a retrieval space which are configured into racks 19 and 19' on the one hand side that are arranged adjacent to each other which are placed directly adjacent to each other and advantageously attached at each other. The two racks 19 and 19' can be configured in the same manner as described supra, however typically the rack 19' in which the retrieving space 4 is arranged that is illustrated in FIG. 6*a, b* is significantly narrower approximately one third as wide as the storage rack 19 wherein several retrieval spaces 4 are arranged respectively on top of each other always at the same level as the storage base 2 arranged adjacent thereto as illustrated in FIGS. 1*a*-2*c*.

This partitioning is provided so that nobody can reach into the storage space 2 since the front side 3 is substantially covered by front plates 11 so that in the height there between only a tool opening 14 is provided that respectively extends over a smaller height as illustrated and described in FIG. 2*b* for a retrieval storage space 2.

The handle of a tool 37, in particular a spoon 33 protrudes outward through this tool opening 14 where the user 100 can apprehend the tool by hand and can push a product P with a front end of the spoon 33 as illustrated in FIG. 6 from the storage space 2 in to the adjacent retrieving space 4 beyond the contact bars 18' on which the divider element 6 rests on one side, thus the storage dish and at which the slightly lower arranged retrieving dish 7 is arranged at the other side.

Thus the product P has to be pushed upward initially from the storage position by the spoon 8 along the lateral ramp 8 of the storage dish and then slides over the flank sloping downward from the storage space 2 to the retrieving space 4 of this special contact bar 18' so that the storage dish rests on the retrieval dish 7.

Between the contact bars 18' that are arranged on top of each other there is a back reach protection device 9 which can respectively either be attached at the bottom side of a contact bar 18' or between the front and rear upright profile 41*a* of the rack 19 or 19' between which the contact bars 18' are attached as well.

This back reach protection device 9 illustrated in an exemplary manner in the side view in FIG. 1*a* at the very top has the effect that products P can only be pushed from the storage space 2 into the retrieval space 4, but not the other way around in that pivot bars 48 extending pivot ably along the entire depth direction 30 are pivot able about a pivot axis 49 extending in the depth direction 30 but however due to a stop 51 which extends at a distance above the pivot axis 49 a portion of the pivot bar 48 extending downward from the pivot axis 49 can only be pivoted from its vertical position slightly to the right in a direction towards the storage space 2, thus not enough to move a product P moved against it from the retrieval space 4 back into the storage space 2. Also the distance between the lower end of the pivot bar 48 and the contact bar 18' is too small for this purpose.

The retrieval spaces 4 are freely accessible from the front side 3 so that the user 100 can retrieve his product P therefrom, thus however only the product P actually selected, thus the user cannot touch a product P in the retrieval space by hand and then move it back into the storage space 2.

FIG. 6*b* illustrates a device that is analogous to the reach back protection device 9 of FIG. 6*a* in which a pivot able side plate 20 is provided instead of the pivot bars 48 wherein the side plate 20 essentially closes a level in the rack 19.

It is an essential difference that the back reach protection device 9 which is attached between two upright profiles 41*a* advantageously can be engaged and disengaged from these upright profiles easily in that sheet metal which is attachable at each of the side surfaces oriented towards each other of an upright profile 41*a* can be attached and which on the other hand side carries the pivot axis 49 that is oriented towards the other, forward or backward upright profile 41*a* and includes an L-shaped laterally open recess 57 by which it is engage able at the stop 51 protruding from the respective upright profile 41*a*.

Furthermore FIG. 6*b* does not illustrate a normal storage dish as a divider element 6 differently from the representation in FIG. 6*a* but a flat heating plate 60 or also cooling plate 60.

The heating plate 60 reaches in the width direction 31 further outward than the storage dish namely approximately to the outer edge of the vertical profile 41*a*. Therefore in order to retrieve the heating plate 60 for example in rear ward direction the heating plate 60 according to the double arrow has to be arranged in a slant angle in top view in order for the heating plate being move able between the upright profiles 41*a* off set in the width direction 31.

Since the side plate 20 of the back reach protection device 9 is arranged in the width range of the vertical profile 41*a* the edge portion of the heating plate 60 would collide with a lower end of the slide plate 20 while being lifted up.

This can be prevented by outward pivoting of the lower portion of the side plate 20, therefore the pivot able side plate 20 is not used as back reach protection device but only to facilitate slanting the heating plate 60 and lifting it out even when no other rack or rack with storage spaces 2 included therein, not with a retrieving space 4 is arranged adjacent to the respective storage space 2.

However when only a separation of two adjacent storage spaces or a thermal block is required the side plate 20 can also be arranged at the rack 19 non-pivot able in particular fixated.

In order to be able to apply a fixed base plate 60 of this type also the contact bars 18 according to FIG. 6*b* are configured differently than in the embodiment according to FIG. 6*a* for normal storage dishes 6.

Viewed in depth direction 30 the main element of the contact bar 18 is a sheet metal profile which is configured approximately V-shaped with a point that is oriented towards a center of the dispensing shelf 1.

The upper arm 61*a* extends essentially horizontally in the mounted condition approximately from the outer edge of the upright profile 41*a* in a direction towards a shelf center and is only slightly tapered downward towards the tip in a portion proximal to the tip and in a transition portion towards the lower arm 61*b*.

The lower arm 61*b* extends at an angle of approximately 45° slanted outward and downward and is only configured horizontally extending in a portion proximal to the tip. In the slanted portion a light bar 40 that also extends in the depth direction 30 is attachable at the bottom side of the lower arm 61*b*.

Beyond the forward and rear free end of the V-shaped sheet metal profile 61 a respectively connected bolt on lobe extends forward and downward wherein the lobe is respectively used for bolting to one of the inward oriented side surfaces of the forward and rear upright profile 41*a*.

From the free edge of the lower arm of the V-shaped sheet metal profile 61 a recess extends into the arm wherein the recess advantageously extends along almost the entire length of the arm in the profile direction. This prevents in particular for two adjacent V-shaped sheet metal profile 61 due to two adjacent racks that deposits are formed on the lower arm. Additionally accessibility towards an interior of the V-shaped sheet metal profile 61 is facilitated e.g. for cleaning purposes.

Attaching two directly adjacent upright profiles 41*a* of adjacent racks 19, 19' at each other is performed in the lower portion advantageously by a connection sleeve 36 as illustrated in FIG. 6*a* in a vertical sectional view and in FIG. 3*b* in a horizontal sectional view.

The connection sleeve 36 is a profile which envelops the two upright profiles 41*a* which is advantageously circumferentially closed. The connecting sleeve is a rectangular profile with an inner space that has twice the size of the rectangular profiles when the two rectangular profiles are used as upright profiles 41*a*.

The two racks 19, 19' only have to be inserted into this connection sleeve 36 when they are set up with the lower ends of their adjacent upright profiles 41*a*.

In the upper portion the two adjacent upright profiles 41*a* can be connected with each other by connecting lobes bolted on their backs through two adjacent upright profiles 41*a* or depth profiles 41*b* with U-clamps or similar inserted over them.

The lower end of the upright profiles 41*a* is typically respectively provided with a stand base from whose base plate a threaded rod protrudes vertically upward wherein the threaded rod can be threaded into a nut which is attached torque proof in a lower end of the upright profile 41*a*, for example pressed in or glued in.

The rack can be horizontally adjusted by threading the stand base. Advantageously the stand base 34 is in top view not larger than the outer contour of the cross section of the upright profile 41*a*.

This way also the lower end of an individual upright profile 41*a* with a stand base 34 attached thereto can be enveloped by a protective sleeve according to FIG. 5*a* receiving only this individual stand base and only this individual lower end, wherein the protective sleeve 41*a* envelops the upright profile 41*a* also at a small distance and is advantageously configured with a rectangular cross section.

Thus the protective sleeve 35 sits gravity induced like the connecting sleeves 36 on the base surface 200 so that cleaning can be performed easily around it whereas cleaning to the threaded pin of the stand base is never possible completely when the protective sleeve 35 is missing.

Figure 4B:
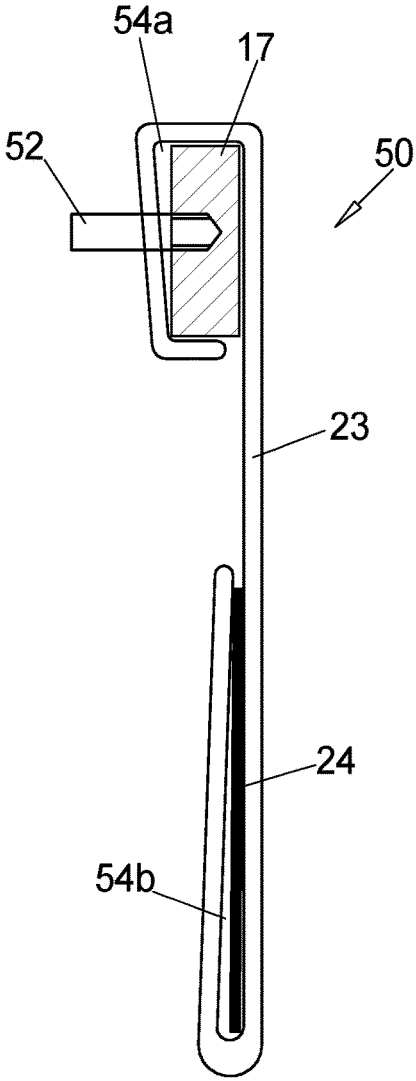

In order to be able to apply a forward price sticker 24 with prices of products P offered in the storage dish 6 at a front side approximately at a level of each storage dish 6 a forward price sticker unit 50 is applied approximately according to FIG. 4*a* at a level of storage dish 6 by engaging a transversal rod 17 of the price sticker unit 50 between the two forward upright profiles 41*a* wherein the transversal rod can also be simultaneously used as a front stop for the storage dish 6 where another forward price sticker holder 23 can be engaged in turn. This price sticker holder is advantageously a plastic profile as illustrated in FIG. 4*b*.

The forward price sticker holder 23 is a plastic plate which has a 180° elbow at and end edge so that a pocket that is narrow in cross section and open on top is generated between the two arms wherein the price sticker 24 can be inserted into the pocket.

The opposite edge of the plastic plate is elbowed three times by approximately 90° respectively so that an almost closed not completely closed I downward direction rectangular profile is generated into which the cross section of the transversal rod 17 fits which also has a rectangular cross section.

Due to elasticity of the forward price sticker holder 23 the triple elbow can be bent up enough so that the price sticker holder 23 can be pushed from above over the transversal rod 17 and the free end of the triple elbowed upper portion of the price sticker holder 23 subsequently locks under the lower edge of the transversal rod 17.

The forward price sticker holder 23 can but does not have to extend over the entire width, thus the longitudinal extension of the transversal rod 17 in the transversal direction 31.

In order to prevent movements in the transversal direction 31 of the price sticker holder 23 relative to the transversal rod 17 a bolt 52 threaded into its back side or even better plural transversally offset bolts can protrude from its back side and the price sticker holder 23 can include at least one vertical slot in its first and second elbowed arm of the upper portion wherein the transversal rod is wide enough to receive the threaded bolt 52 therein and to achieve a fixation in the transversal direction 31.

If the dispensing shelves 1 shall be filled from the back side 22 of the rack 19 it is helpful when the dispensing shelves 1 include a price sticker unit 50' according to FIG. 2*e* also at their back side 22 at each level wherein the price sticker units include a rear price sticker holder 23' for inserting a price sticker 24 so that the operators can see at which level, thus on which divider element 6 which type of product P has to be applied. For the operator certainly primarily the product type stated on the price sticker is relevant and the price is much less relevant which however is still provided since the same price sticker 24 can be used as on the front side 3.

The rear price sticker unit 50' includes a support profile 64 which is typically made from metal and which extends in the width direction horizontally between the rear left and the rear right upright profile 41*a* and which is attached at a transversal rod 17', advantageously bolted down wherein the transversal rod 17' also extends in the width direction 31 wherein the transversal rod 17' is respectively attached between the rear upright profiles 41*a* or slightly below a level of a respective rear end of one of the divider elements 6.

In case a respective rear transversal profile 41*c* is provided at these levels which however typically is only the case at the level of the lowest divider element 6 the support profile 64 can also be attached directly at the transversal profile 41*c*.

Viewed in the width direction 31 the support profile 64, typically a folded sheet metal component includes an upper most arm 64 which is attached vertically extending at the front side of the transversal rod 17' and which represents the freely terminating arm of an upward open U-shaped profile element which protrudes from the arm of the profile element which profile element is in front in the depth direction 30 and the arm terminates freely and protrudes from the transversal rod 17' in a rear ward direction.

The other rear freely terminating U-arm 64*b* of this U-shape is shorter thus does not protrude upward like the forward arm 64 and continues with its upper end through a 180° bend in a support arm 64*c* extending from this bend vertically downward or at a slant angle in down ward and rear ward direction wherein the support arm 64*c* includes an approximately half circular bend at its lower end in upward and forward direction towards the transversal rod 17' as a termination.

Onto this support arm 64*c* the rear price sticker holder 23' can be snapped locked wherein the rear price sticker holder also includes a profile extending in the transversal direction 31, however made from an elastic synthetic material in that the price sticker holder 23' is approximately U-shaped, open in upward direction and includes a forward and downward elbow at an upper end of its forward freely terminating arm 23*a* wherein the elbow can reach around the upper 180° bend of the support arm 64*c* and includes an forward upward oriented lower elbow at an appropriate distance to the upper elbow in a lower portion of its forward freely terminating arm, at least in the end portions of its extension so that the lower elbow can include the semi-circular lower bend at the lower end of the support arm 64*c* and thus the price sticker holder 23' is snap locked onto the support arm.

In order for contaminations like e.g. bread crumbs not being able to fall into the upward open price sticker holders 23' a roof arm 59*a* extends in the transversal direction 31 over an entire extension of the price sticker holder 23' wherein the roof arm is part of a folded sheet metal roof profile bar 59 which is configured V-shaped and bolted with its vertically oriented attachment arm 59*b* between the support profile 64 and the rear transversal rod 17'. From this upper end the roof arm 59*a* of the roof bar 59 extends in profile direction backward downward and in the transversal direction 31 along the rear price sticker holder 23' at a sufficient elevation distance so that inserting a non-illustrated price sticker from above into the rear price sticker holder 23' is quite feasible.

In the lowest rear price sticker unit 50' which is typically arranged at a level of the lowest transversal profile 41*c* the price sticker holder 23' is protected against objects approached from a rear like e.g. a broom in that a stop bar 58 is additionally bolted down between the support profile 64 and the rear transversal rod 17' wherein the stop bar is advantageously fabricated as a folded sheet metal component again.

Wherein the stop bar 58 is in turn made from an upper attachment arm that extends vertically and parallel to the transversal rod 17' wherein an approximately horizontally V-profile adjoins with its upper end integrally at a lower end of the attachment arm wherein the V-profile protrudes in the back ward direction beyond the rear price sticker holder 23' and extends below it wherein the upper arm of the V-profile slopes downward backward so that no bread crumbs can accumulate thereon and the lower arm extends approximately horizontally in forward direction in the depth direction 30.

The roof bar 59 and the stop bar 58 can also be configured integrally together however the lower stop bar 58 is then also provided on each level which is not mandatory.

Furthermore FIGS. 7*a* and *b* illustrate special configurations of the rack 19 and the dispensing shelf 1 built therefrom.

In FIG. 7*a* the rack 19' can have the same configuration as illustrated in the preceding figures and described with reference thereto however the entire storage portion 2', thus the inner space is essentially filled above the lowest transversal profile 41*c* by a cooling module 65 which essentially fills the free inner cross section, viewed from above the rack 19 and which is a refrigerator that is open in forward direction entirely or on individual levels at least partially wherein compartment bases of the refrigerator can offer products to be cooled like e.g. bottles or cans or snacks therefore the rack only has an upper most transversal profile at an upper end of the upright profiles 41*a*, in this case typically above the lowest transversal profile 41*c*.

In the elevation range below the lowest transversal profile 41*c*, the base space 12 typically refrigeration equipment is installed advantageously with an operating unit that can be viewed from a front and/or a display unit in the base front plate 16.

The dispensing shelf 1 according to FIG. 7*b* thus includes a bread slicer 66 in the lowest portion wherein the bread slicer rests on the support base 200 and essentially fills the free inner cross section viewed from above of the rack 19". In elevation direction the bread slicer 66 which can be used by customers to cut the bread load retrieved from the dispensing shelf 1 in slices beyond a level of the basic space of the rack 19 up to approximately half the level of the rack so that the lowest transversal profile 21*c* is not provide in this rack 19" any more.

At the front side of the bread slicer 66 a suspension rail 67 is attached that extends in the width direction 31 and wherein paper bags 68 can be provided which hang down from the suspension rail wherein the sliced bread can be subsequently packaged in the paper bags.

For handling sufficient space must be provided above the bread slicer 66 wherein typically only an upper most divider element 6 is arranged in the upper portion of the storage portion 2' in the rack 19'.

From the relatively few described components dispensing shelf units can be assembled which are configured quite differently, in particularly according to hygiene regulations with different levels of strictness.

REFERENCE NUMERALS AND DESIGNATIONS

1 dispensing shelf
2 storage space
2' storage portion
3 front side of storage space
4 retrieval space
5 retrieval opening
6 storage dish/divider element
7 storage dish
8 ramp of storage dish
9 back reach protection device
10 rear door
11 pane, storage front plate
11' transition front plate
11'*a* upper transition element
11'*b* lower transition element
11" terminal front plate
12 base space
12' base portion
13 pivot able element
14 tool opening
15 magnet foil
16 base front plate
16*a* pass through opening
16*b* core plate
17, 17' front or rear transversal rod
18 contact bar
19 frame, rack
20 lower protection plate
21 hinge
22 back side
23 front price sticker holder
23' rear price sticker holder
23'*a* front arm
24 price sticker
25 closing damper
26 magnet
27 contact damper
28 insertion opening
29 cover element
30 depth direction
31 width direction, transversal direction
32 tool holder
33 spoon pusher
34 stand base
35 protective sleeve
36 connecting sleeve
37 tool
38 paper bag box
39 trash container
40 light bar
41 profile
41*a* upright profile
41*b* depth profile
41*c* transversal profile
42 cover plate
43 power supply unit
44 vertical
45 locking mechanism
45*a* locking bar protrusion
46 opposite element
47 pivot axis
48 pivot bar
49 pivot axis
50 forward price sticker unit
50' rear price sticker unit
51 stop
52 threaded bolt
53 metal plate
54 coating

55 flap
56 guide plate
57 recess
58 stop bar
59*a, b* roof bar
60 heating plate, cooling plate
61 sheet metal profile
61*a, b* arm
62 screw lug
63 front stop
64 support profile
64*a* upper most arm
64*b* U-arm
64*c* support arm
65 cooling module
66 bread slicer
67 suspension rail
68 paper bag
100 retrieving person
101 fist, hand
200 support base
P product

The invention claimed is:

1. A kit for assembling a dispensing shelf for storing, presenting and dispensing to a user a food product, wherein the kit provides for assembly of the dispensing shelf to accommodate hygiene regulations with different levels of strictness, the kit comprising:

a rack configured as a frame, the rack defining a storage and retrieval space for storing, visibly displaying, and allowing the retrieving of the food product, the rack including:

a front side, a back side oriented away from the front side, and a right side and a left side, each side extending from the front side to the back side of the storage space; and first and second storage front plates, the first storage front plate defining a first retrieval opening and the second storage front plate defining a second retrieval opening, wherein the first retrieval opening and the second retrieval opening are different sizes, and further wherein each storage front plate is configured to be installed on the front side of the rack, wherein the kit allows for installation of the first front plate to accommodate a first level of hygiene strictness for which the first plate opening is appropriate, and the kit allows for installation of the second front plate to accommodate a second level of hygiene strictness for which the second plate opening is appropriate.

2. The kit of claim 1 further wherein the kit provides for assembly of the dispensing shelf without installation of either of the first and second storage plates, wherein the dispensing shelf provides a completely open front side to accommodate a third level of hygiene strictness.

3. The kit of claim 1 wherein the first and second retrieval openings are positioned in their respective storage front plates and each opening is defined by an edge portion of each storage front plate, each edge portion enveloping the respective retrieval opening.

4. The kit of claim 1, characterized in that each storage front plate is transparent glass.

5. The kit of claim 1, further comprising plural storage and retrieval spaces arranged to be one on top of another.

6. The kit of claim 5, wherein the plural storage and retrieval spaces are separated from one another in elevation by a respective storage dish.

7. The kit of claim 1, characterized in that the storage and retrieval space extends over an entire width of the rack.

8. The kit of claim 1, characterized in that the front side is inclined at least in an upper portion relative to vertical, such that the front side includes a lower edge and an upper edge, and the lower edge is further remote from the back side than the upper edge.

9. The kit of claim 1, further comprising plural storage and retrieval spaces arranged to be one on top of another and at least one divider element separating one of the storage and retrieval spaces from the storage and retrieval space below, wherein the at least one divider element is arranged upward sloping from a respective front to a respective rear to rise along the depth direction.

10. The kit of claim 1, further comprising at least three storage and retrieval spaces arranged to be one on top of another and at least two divider elements, each divider element separating one of the storage and retrieval spaces from the storage and retrieval space below, wherein the two divider elements are arranged upward sloping from a respective front to a respective rear to rise along the depth direction, and wherein the divider elements are arranged one on top of another with a respective slope of each of the divider elements that increases from a lowest divider element to an upper-most divider element.

11. The kit of claim 1, further comprising plural storage and retrieval spaces arranged to be one on top of another and at least one divider element separating one of the storage and retrieval spaces from the storage and retrieval space below, wherein the divider element is selected from a group consisting of a heating plate and a cooling plate.

12. The kit of claim 1, characterized in that each retrieval opening is defined by an edge portion of each of a pair of upper and lower storage front plate elements, the edge portions together enveloping the retrieval opening.

13. The kit of claim 12, characterized in that at least one of the pair of upper and lower storage front plate elements is H-shaped.

14. The kit of claim 12, characterized in that at least one of the pair of upper and lower storage front plate elements is U-shaped.

15. The kit of claim 1, characterized in that each storage front plate comprises an upper storage front plate element and a lower storage front plate element.

16. The kit of claim 1, characterized in that a base space is provided below the storage and retrieval space and is closed on a front side by a base front plate defining an upper edge, and the base front plate is movably attached by a hinge at the upper edge for movement between a closing position closing the front side of the base space and a releasing open position at the rack.

17. The kit of claim 16, characterized in that a closing damper for slowing down a closing movement of the base front plate is arranged between the base front plate and the rack.

18. The kit of claim 1, characterized in that the rack includes a protective sleeve which is configured to receive a lower end of an upright profile of the rack including a stand base attached thereto and which rests on a support base.

19. The kit of claim 1, characterized in that the rack includes upright profiles and a connection device for connecting with an adjacent rack, and the connection device includes a connection sleeve sized to receive two adjacent upright profiles of two adjacent racks.

20. A dispensing shelf for storing, presenting and dispensing a food product to a user, wherein the dispensing shelf comprises:

a rack configured as a frame, the rack defining a storage and retrieval space for storing, visibly displaying, and allowing the retrieving of the food product, the rack including:

a front side, a back side oriented away from the front side, wherein the storage and retrieval space is located between the front side and the back side, and a right side and a left side, each side extending from the front side to the back side alongside the storage and retrieval space; and a storage front plate comprising an upper storage front plate element and a lower storage front plate element, wherein each of the upper storage front plate element and a lower storage front plate element include an edge portion, the edge portions defining a retrieval opening, the storage front plate installed on the front side of the rack, the edge portions enveloping the retrieval opening and providing for the user reaching a hand or tool through the retrieval opening without movement of the storage front plate.

21. The dispensing shelf of claim 20, characterized in that at least one of the upper and lower storage front plate elements is H-shaped.

22. The dispensing shelf of claim 20, characterized in that at least one of the upper and lower storage front plate elements is U-shaped.

23. A kit for assembling a dispensing shelf for storing, presenting and dispensing to a user a food product, wherein the kit provides for assembly of the dispensing shelf to accommodate hygiene regulations with different levels of strictness, the kit comprising:

a rack configured as a frame, the rack defining a storage and retrieval space for storing, visibly displaying, and allowing the retrieving of the food product, the rack including:

a front side, a back side oriented away from the front side, and a right side and a left side, each side extending from the front side to the back side of the storage space; and first and second storage front plates, the first storage front plate defining a first retrieval opening and the second storage front plate defining a second retrieval opening, wherein the first retrieval opening and the second retrieval opening are different sizes, wherein the first retrieval opening is defined by a first edge portion of the first storage front plate, the first edge portion enveloping the first retrieval opening, and wherein the second retrieval opening is defined by a second edge portion of the second storage front plate, the second edge portion enveloping the second retrieval opening, and further wherein each storage front plate is configured to be installed on the front side of the rack, and further wherein the kit allows for installation of the first front plate to accommodate a first level of hygiene strictness for which the first plate opening is appropriate, and the kit allows for installation of the second front plate to accommodate a second level of hygiene strictness for which the second plate opening is appropriate, and further wherein, when the first storage plate is installed, the first retrieval opening provides for the user reaching through the first retrieval opening without movement of the first storage front plate and, when the second storage plate is installed, the second retrieval opening provides for the user reaching through the second retrieval opening without movement of the second storage front plate.

24. The kit of claim 23, characterized in that each retrieval opening is defined by an edge portion of each of a pair of upper and lower storage front plate elements, the edge portions together enveloping the retrieval opening.

25. The kit of claim 24, characterized in that at least one of the upper and lower storage front plate elements is H-shaped.

26. The kit of claim 24, characterized in that at least one of the upper and lower storage front plate elements is U-shaped.

* * * * *